US012473792B2

(12) United States Patent
Nguyen et al.

(10) Patent No.: US 12,473,792 B2
(45) Date of Patent: Nov. 18, 2025

(54) SYSTEMS AND METHODS FOR CEMENTING CASING AND SEALING A HANGER IN A WELLHEAD HOUSING

(71) Applicant: Cameron International Corporation, Houston, TX (US)

(72) Inventors: Dennis Nguyen, Houston, TX (US); Leonard Vogel, Houston, TX (US); Kyle Sommerfeld, Houston, TX (US); Andrew Sanders, Houston, TX (US); Bruce Hogg, Houston, TX (US); Tin Nguyen, Houston, TX (US); Brandon Blake Shirley, Houston, TX (US)

(73) Assignee: Cameron International Corporation, Houston, TX (US)

( * ) Notice: Subject to any disclaimer, the term of this patent is extended or adjusted under 35 U.S.C. 154(b) by 0 days.

(21) Appl. No.: 18/748,134

(22) Filed: Jun. 20, 2024

(65) Prior Publication Data

US 2024/0426188 A1 Dec. 26, 2024

Related U.S. Application Data

(60) Provisional application No. 63/509,071, filed on Jun. 20, 2023.

(51) Int. Cl.
*E21B 33/05* (2006.01)

(52) U.S. Cl.
CPC ..... *E21B 33/05* (2013.01)

(58) Field of Classification Search
CPC ..... E21B 33/05
See application file for complete search history.

(56) References Cited

U.S. PATENT DOCUMENTS

| | | | | |
|---|---|---|---|---|
| 4,848,457 | A | 7/1989 | Lilley | |
| 9,611,717 | B2 | 4/2017 | Lockwood | |
| 2010/0193195 | A1* | 8/2010 | Nguyen | E21B 23/00 166/338 |
| 2011/0226490 | A1* | 9/2011 | Nguyen | E21B 33/04 166/382 |
| 2013/0341032 | A1 | 12/2013 | Hendrie | |
| 2014/0158366 | A1* | 6/2014 | Smith | E21B 33/043 166/368 |
| 2015/0114668 | A1 | 4/2015 | Mansukh | |
| 2016/0010417 | A1 | 1/2016 | Lockwood | |
| 2016/0326838 | A1 | 11/2016 | Porter | |
| 2018/0171733 | A1* | 6/2018 | Nguyen | E21B 33/04 |
| 2018/0187513 | A1* | 7/2018 | Lundheim | E21B 34/04 |
| 2022/0018203 | A1 | 1/2022 | Bartlett | |

* cited by examiner

*Primary Examiner* — Taras P Bemko
(74) *Attorney, Agent, or Firm* — Jeffrey D. Frantz

(57) ABSTRACT

A wellhead system includes a wellhead housing and a hanger configured to support a casing within the wellhead housing. The hanger includes one or more passages formed through the hanger. The wellhead system also includes a seal assembly configured to move relative to the hanger to selectively enable a flow of fluid across the hanger via the one or more passages. The hanger, the seal assembly, and a lock ring may be run together into the wellhead housing.

16 Claims, 27 Drawing Sheets

SYSTEMS AND METHODS FOR CEMENTING CASING AND SEALING A HANGER IN A WELLHEAD HOUSING

CROSS-REFERENCE TO RELATED APPLICATION

This application claims priority to and the benefit of U.S. Provisional Application Ser. No. 63/509,071, entitled "SYSTEMS AND METHODS FOR CEMENTING CASING AND SEALING A HANGER IN A WELLHEAD HOUSING" and filed Jun. 20, 2023, the disclosure of which is incorporated herein by reference in its entirety for all purposes.

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Natural resources, such as oil and gas, are used as fuel to power vehicles, heat homes, and generate electricity. Once a desired natural resource is discovered below a surface of the earth, mineral extraction systems are often employed to access and extract the desired natural resource. The mineral extraction systems may be located onshore or offshore depending on the location of the desired natural resource. The mineral extraction systems generally include a wellhead through which the desired natural resource is extracted. The wellhead may include or be coupled to a wide variety of components, such as a tubing hanger that supports a tubing, a casing hanger that supports a casing, valves, fluid conduits, and the like.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In certain embodiments, a wellhead system includes a wellhead housing and a hanger configured to support a casing within the wellhead housing. The hanger includes one or more passages formed through the hanger. The wellhead system also includes a seal assembly configured to move relative to the hanger to selectively enable a flow of fluid across the hanger via the one or more passages.

In certain embodiments, a wellhead system includes a hanger assembly configured to be run into a wellhead housing. The hanger assembly includes a hanger with one or more passages formed through the hanger. The hanger assembly also includes a seal assembly configured to move relative to the hanger to selectively enable a flow of fluid across the hanger via the one or more passages.

In certain embodiments, a method of operating a wellhead system includes running a hanger and a seal assembly together into a wellhead housing. The method also includes routing, during cementing operations, a flow of fluid across the seal assembly via one or more passages formed in the hanger. The method further includes moving, after the cementing operations, the seal assembly relative to the wellhead housing, the hanger, or both to block the flow of fluid across the seal assembly via the one or more passages formed in the hanger.

BRIEF DESCRIPTION OF THE DRAWINGS

Various features, aspects, and advantages of the present disclosure will become better understood when the following detailed description is read with reference to the accompanying figures in which like characters represent like parts throughout the figures, wherein.

DETAILED DESCRIPTION OF SPECIFIC EMBODIMENTS

One or more specific embodiments of the present disclosure will be described below. These described embodiments are only exemplary of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Certain embodiments of the present disclosure generally relate to systems and methods that support efficient casing installation operations. For example, certain embodiments of the present disclosure include one or more passages formed in (e.g., through) a hanger (e.g., hanger body) that supports the casing. The one or more passages are selectively sealed via a seal assembly (e.g., movable seal component), such as a ring, a plug, a piston, an inflatable bladder, or a valve. Thus, the seal assembly may selectively enable or block a flow of fluid across the hanger (e.g., axially across the hanger).

In particular, during cementing operations, the seal assembly may be positioned to enable the flow of fluid through the one or more passages formed in the hanger. Then, after the cementing operations, the seal assembly may be positioned to block the flow of fluid through the one or more passages formed in the hanger (e.g., to seal the one or more passages).

Advantageously, the systems and methods disclosed herein enable the seal assembly to run with the hanger into the wellhead housing (e.g., rather than running the hanger into the wellhead housing, then conducting cementing operations, and then running the seal assembly into the wellhead housing). Accordingly, the systems and methods disclosed herein may save time and associated costs during drilling operations.

Figure 1:
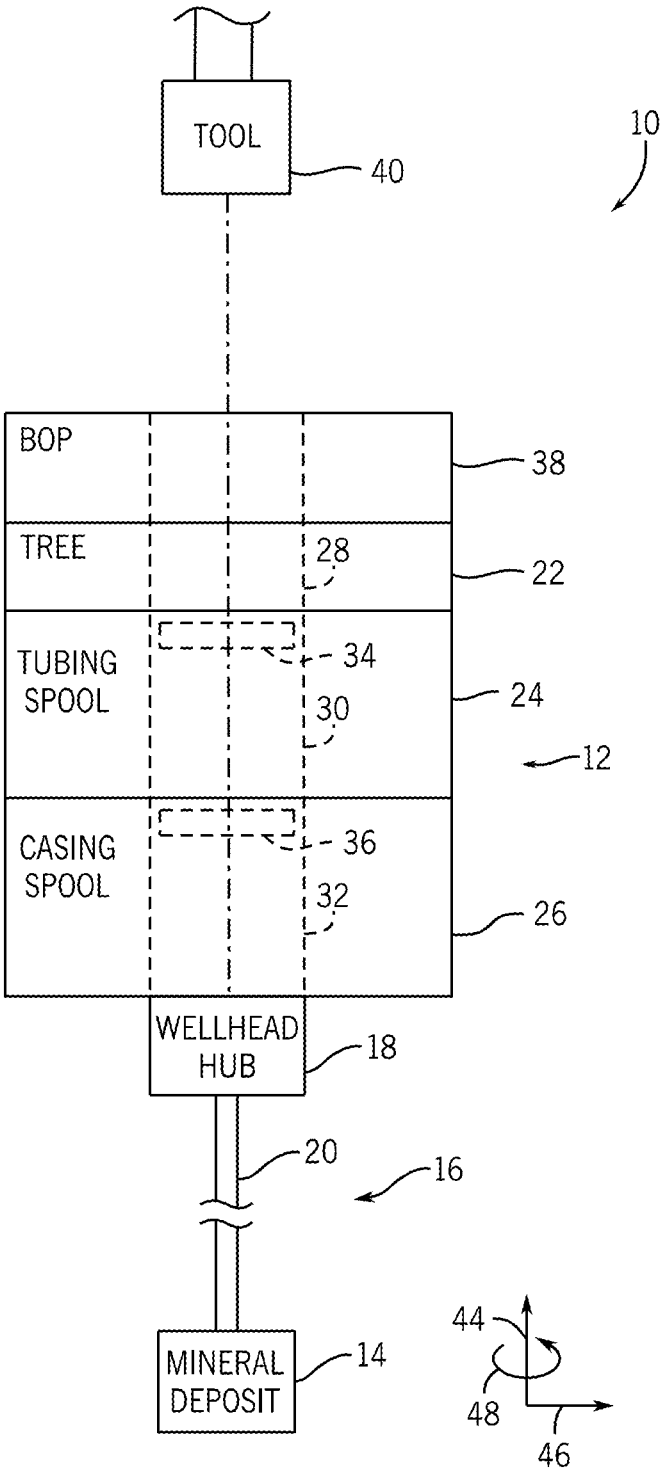
FIG. 1 is a block diagram of a mineral extraction system, in accordance with an embodiment of the present disclosure.

With the foregoing in mind, FIG. 1 is a block diagram of an embodiment of a mineral extraction system 10. The mineral extraction system 10 may be utilized to access and/or extract various natural resources (e.g., hydrocarbons, such as oil and/or natural gas) from the earth. As illustrated, the mineral extraction system 10 includes a wellhead 12 (e.g., annular wellhead) coupled to a mineral deposit 14 via a well 16. The well 16 may include a wellhead hub 18 (e.g., annular wellhead hub) and a wellbore 20. The wellhead hub 18 generally includes a large diameter hub disposed at an end of the wellbore 20 and is configured to connect the wellhead 12 to the wellbore 20. As will be appreciated, the wellbore 20 may contain elevated pressures. For example, the wellbore 20 may include pressures that exceed 10,000, 15,000, or even 20,000 pounds per square inch (psi). Accordingly, the mineral extraction system 10 may employ various mechanisms, such as seals, plugs, and valves, to control and regulate the well 16.

In the illustrated embodiment, the mineral extraction system 10 includes a tree 22, a tubing spool 24, a casing spool 26, and a blowout preventer (BOP) 38. The tree 22 generally includes a variety of flow paths (e.g., bores), valves, fittings, and controls for operating the well 16. Further, the tree 22 may provide fluid communication with the well 16. For example, the tree 22 includes a tree bore 28 that provides for completion and workover procedures, such as the insertion of tools (e.g., a tool 40) into the well 16, the injection of various chemicals into the well 16, and so forth. Further, the natural resources extracted from the well 16 may be regulated and routed via the tree 22. For example, the tree 22 may be coupled to a flowline that is tied back to other components, such as a manifold.

As shown, the tubing spool 24 may provide a base for the tree 22 and includes a tubing spool bore 30 that connects (e.g., enables fluid communication between) the tree bore 28 and the well 16. As shown, the casing spool 26 may be positioned between the tubing spool 24 and the wellhead hub 18 and includes a casing spool bore 32 that connects (e.g., enables fluid communication between) the tree bore 28 and the well 16. Thus, the tubing spool bore 30 and the casing spool bore 32 may provide access to the wellbore 20 for various completion and workover procedures. The BOP 38 may consist of a variety of valves, fittings, and controls to block oil, gas, or other fluid from exiting the well 16 in the event of an unintentional release of pressure or an overpressure condition.

As shown, a tubing hanger 34 is positioned within the tubing spool 24. The tubing hanger 34 may be configured to support tubing (e.g., a tubing string) that is suspended in the wellbore 20 and/or to provide a path for control lines, hydraulic control fluid, chemical injections, and so forth. Additionally, as shown, a casing hanger 36 is positioned within the casing spool 26. The casing hanger 36 may be configured to support casing (e.g., a casing string) that is suspended in the wellbore 20. The tool 40 may be utilized to lower the tubing hanger 34 into the tubing spool 24 and/or the casing hanger 36 into the casing spool 26.

As discussed in more detail herein, one or more passages may be formed in a hanger (e.g., the hanger 34, 36), and the one or more passages are selectively sealed via a seal assembly (e.g., a ring, a plug, a piston, an inflatable bladder, a valve). During cementing operations, the seal assembly may be positioned to enable a flow of fluid through the one or more passages formed in the hanger. Thus, the flow of fluid may pass from below the hanger to above the hanger (e.g., relative to the wellbore) via the one or more passages. Then, after the cementing operations, the seal assembly may be positioned to block the flow of fluid through the one or more passages formed in or through the hanger (e.g., to seal the one or more passages formed in the hanger). Thus, the flow of fluid may not pass from below the hanger to above the hanger via the one or more passages. To facilitate discussion, the mineral extraction system 10, and the components therein, may be described with reference to an axial axis or direction 44, a radial axis or direction 46, and a circumferential axis or direction 48.

Figure 2:
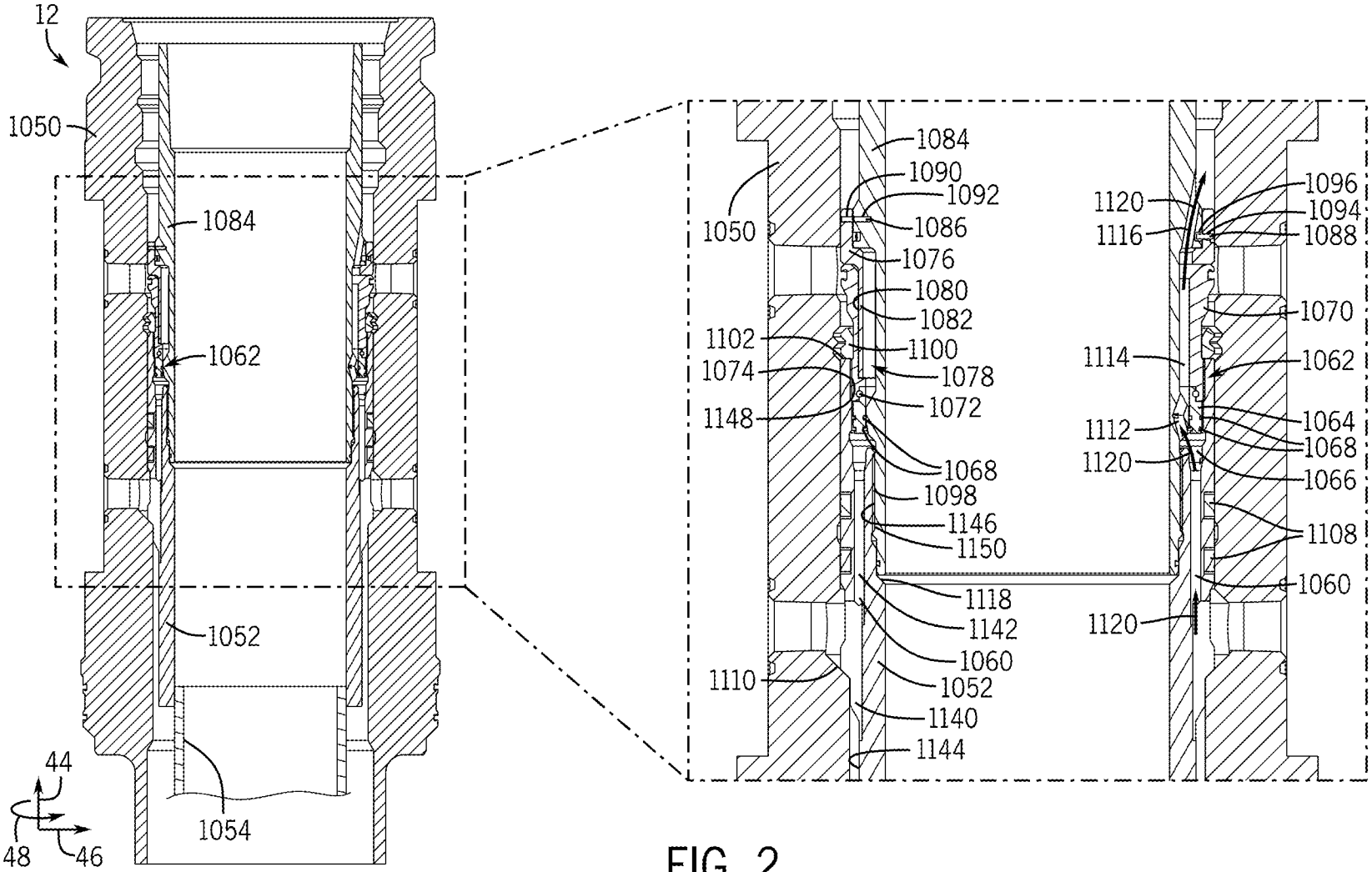
FIG. 2 is a cross-sectional side view of an embodiment of a portion of a wellhead that may be utilized in the mineral extraction system of FIG. 1, wherein a hanger includes one or more passages and is in a landed position.
Figure 3:
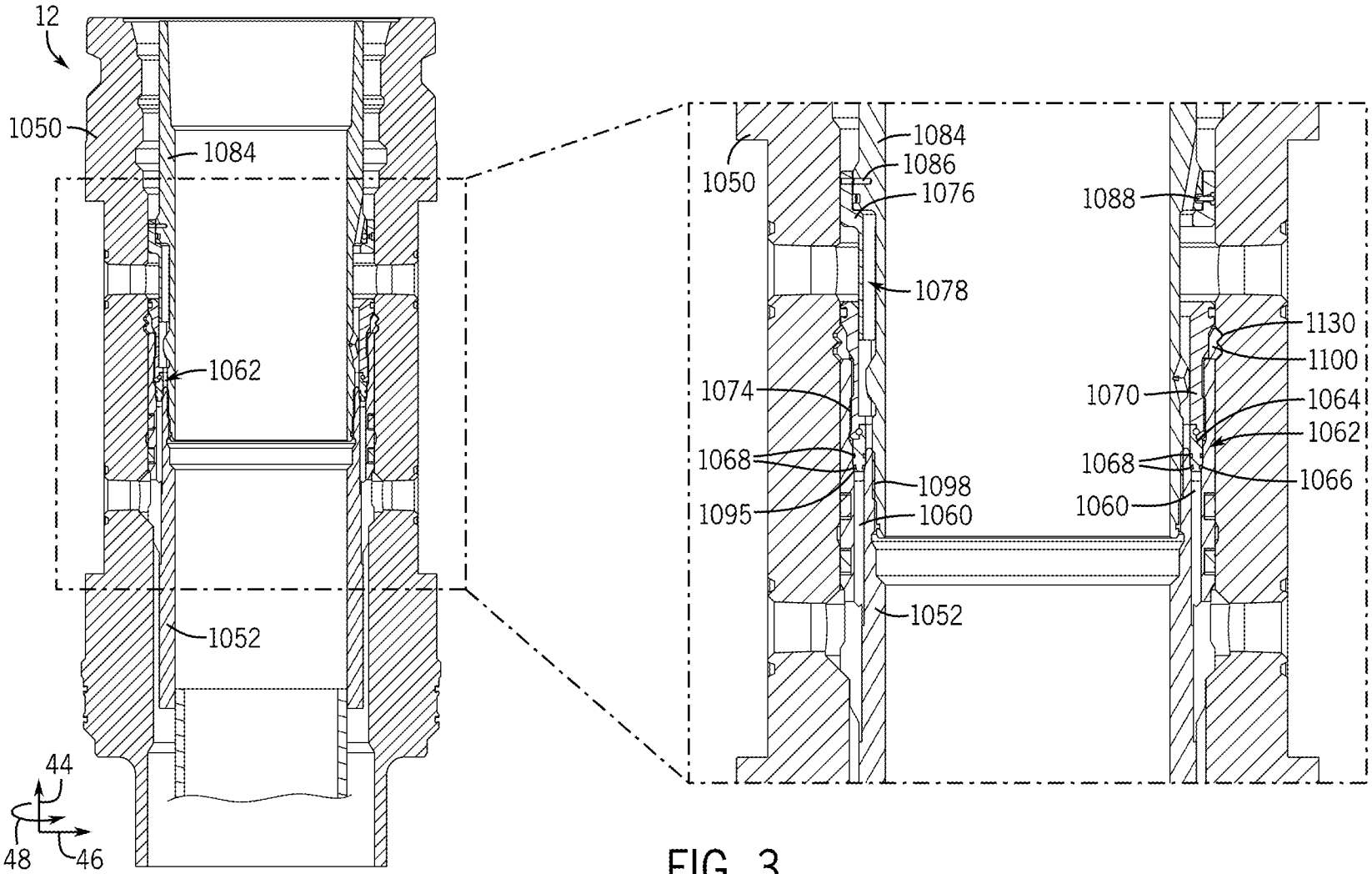
FIG. 3 is a cross-sectional side view of an embodiment of the portion of the wellhead of FIG. 2, wherein the hanger is in a sealed and locked position.

FIGS. 2 and 3 are cross-sectional side views of an embodiment of a portion of the wellhead 12, and FIGS. 4-7 are various views of components that may be utilized in the portion of the wellhead 12 of FIGS. 2 and 3. As shown in FIG. 2, the portion of the wellhead 12 includes a wellhead housing 1050 (e.g., a portion of a casing spool, such as a portion of the casing spool 26 of FIG. 1) and a hanger 1052 (e.g., a casing hanger, such as the casing hanger 36 of FIG. 1). The hanger 1052 is positioned in the wellhead housing 1050 and suspends a casing 1054 that extends into a wellbore. For example, the casing 1054 may pass through one or more additional casings and/or a conductor to extend into the wellbore.

The hanger 1052 includes one or more passages 1060 (e.g., axial passages). In certain embodiments, the one or more passages 1060 include multiple passages 1060 that are distributed circumferentially about the hanger 1052 (e.g., spaced apart about the circumferential axis 48). The one or more passages 1060 may have any cross-sectional shape (e.g., taken in a plane orthogonal to the axial axis 44), such as an oval cross-sectional shape, a crescent cross-sectional shape, a circular cross-sectional shape, a square cross-sectional shape, or any other suitable shape.

A seal assembly 1062 (e.g., annular seal assembly) is positioned proximate to of the hanger 1052. The seal assembly 1062 may include a seal body 1064 (e.g., annular seal body; ring; a one-piece, solid body) that is configured to move relative to the hanger 1052 to fit within a pocket portion 1066 (e.g., annular pocket or recess) of the hanger 1052, as described herein. The seal body 1064 may include one or more seal grooves (e.g., annular seal grooves) that support one or more seal elements 1068 (e.g., annular seal elements).

Additionally, the seal assembly 1062 may include an energizing sleeve 1070 (e.g., annular sleeve; threaded sleeve; ring; a one-piece, solid body) that is coupled to the seal body 1064, such as via a retainer 1072. The retainer 1072 may include an annular retaining wire or other structure that blocks movement of the energizing sleeve 1070 relative to the seal body 1064 along the axial axis 44, while enabling rotation of the energizing sleeve 1070 relative to the seal body 1064 in the circumferential direction 48.

As shown, the energizing sleeve 1070 is coupled to the hanger 1052 via a threaded interface 1074 (e.g., threads on a radially outer surface of the energizing sleeve 1070 and corresponding threads on a radially inner surface of the hanger 1052). The threaded interface 1074 may be arranged such that the energizing sleeve 1070 threads onto the hanger 1052 when the energizing sleeve 1070 is rotated in a first rotational direction along the circumferential axis 48 (e.g., a first direction threaded interface).

A portion of the seal assembly 1062, such as the energizing sleeve 1070, is also coupled (e.g., non-rotatably; rotationally locked; axially free) to a torque sleeve 1076 (e.g., annular body; ring; a one-piece, solid body) via a castellated interface 1078 (e.g., key-slot interface). As shown, in certain embodiments, the castellated interface 1078 may be formed with one or more grooves 1080 (e.g., castellations) formed in a radially inner surface of the energizing sleeve 1070 that receive one or more extensions 1082 (e.g., corresponding castellations) of the torque sleeve 1076. For example, the one or more extensions 1082 may be inserted into the one or more grooves 1080 by aligning the one or more extensions 1082 with the one or more grooves 1080 along the circumferential axis 48, and then by moving the torque sleeve 1076 relative to the energizing sleeve 1070 along the axial axis 44

(e.g., lowering the torque sleeve 1076 into the energizing sleeve 1070; to overlap with the energizing sleeve 1070 along the axial axis 44).

When coupled together in this way, the one or more extensions 1082 of the torque sleeve 1076 overlap with portions of the energizing sleeve 1070 (e.g., side walls that define the one or more grooves 1080) along the axial axis 44 and along the radial axis 46. Accordingly, when engaged, the castellated interface 1078 enables rotation of the torque sleeve 1076 to drive rotation of the energizing sleeve 1070 (e.g., via contact between the side walls that define the one or more grooves 1080 of the energizing sleeve 1070 and corresponding side walls of the one or more extensions 1082 of the torque sleeve 1076; blocks rotation of the torque sleeve 1076 relative to the energizing sleeve 1070 in the circumferential direction 48). For example, the castellated interface 1078 enables rotation of the torque sleeve 1076 in the first direction to drive rotation of the energizing sleeve 1070 in the first direction, as well as rotation of the torque sleeve 1076 in a second direction to drive rotation of the energizing sleeve 1070 in the second direction. Further, even when engaged, the castellated interface 1078 enables movement of the torque sleeve 1076 relative to the energizing sleeve 1070 along the axial axis 44.

In certain embodiments, the one or more grooves 1080 include multiple grooves 1080 that are distributed circumferentially about the energizing sleeve 1070 (e.g., spaced apart about the circumferential axis 48). In some such cases, the one or more extensions 1082 may include multiple extensions 1082 that are distributed circumferentially about the torque sleeve 1076 (e.g., spaced apart about the circumferential axis 48) to engage at least some of the multiple grooves 1080. It should be appreciated that the castellated interface 1078 may have any suitable form or configuration that enables techniques described herein.

The torque sleeve 1076 may be coupled to a running tool 1084 (e.g., annular running tool), such as via one or more shear pins 1086 and via one or more set screws 1088. As shown, the one or more shear pins 1086 extend radially between one or more first shear pin openings 1090 (e.g., openings or recesses) formed in the torque sleeve 1076 and one or more second shear pin openings 1092 (e.g., openings or recesses) formed in the running tool 1084. In particular, each of the one or more shear pins 1086 is positioned within a respective one of the one or more first shear pin openings 1090 and a respective one of the one or more second shear pin openings 1092. As described herein, the one or more shear pins 1086 enable rotation of the running tool 1084 to drive or cause rotation of the torque sleeve 1076 (e.g., the running tool 1084 and the torque sleeve 1076 rotate together while the one or more shear pins 1086 are intact).

As shown, the torque sleeve 1076 may include one or more set screw openings 1094, and each of the one or more set screws 1088 may be threaded into a respective one of the one or more set screw openings 1094. Further, each of the one or more set screws 1088 may extend radially into a running tool groove 1096 (e.g., annular groove) formed in a radially outer surface of the running tool 1084. As described in more detail herein, after the one or more shear pins 1086 shear, the one or more set screws 1088 enable the running tool 1084 to drive (e.g., withdraw; pull) the torque sleeve 1076 with the running tool 1084 along the axial axis 44 (e.g., the one or more set screws 1088 keep the running tool 1084 and the torque sleeve 1076 constrain or block relative movement along the axial axis 44, but allow relative rotation about the axial axis 44).

The running tool 1084 is coupled to the hanger 1052 via a threaded interface 1098 (e.g., threads on a radially outer surface of the running tool 1084 and corresponding threads on a radially inner surface of the hanger 1052). The threaded interface 1098 may be arranged such that the running tool 1084 threads onto the hanger 1052 when the running tool 1084 is rotated in a second rotational direction along the circumferential axis 48 (e.g., a second direction threaded interface; the second rotational direction is opposite the first rotational direction). As shown, a lock ring 1100 (e.g., c-ring) is positioned about the energizing sleeve 1070. In some embodiments, the lock ring 1100 is supported on a hanger shoulder 1102 (e.g., axially facing surface). In FIG. 2, the lock ring 1100 does not engage the wellhead housing 1050, and thus, the hanger 1052 may be considered to be in an unlocked position (e.g., an unlocked, landed position).

In operation, the running tool 1084 may lower the hanger 1052 with the casing 1054 and the seal assembly 1062 into the wellhead housing 1050. It should be appreciated that the running tool 1084 may lower the hanger 1052 with the casing 1054 and the seal assembly 1062, along with the lock ring 1100 positioned about the energizing sleeve 1070. With reference to FIG. 2, the running tool 1084 may lower the hanger 1052 until the hanger 1052 reaches a landed position in which the hanger 1052 is landed on the wellhead housing 1050 (e.g., axially facing or radially overlapping surfaces contact one another at an interface 1110 to block further movement of the hanger 1052 relative to the wellhead housing 1050 toward the wellbore). As shown, one or more hanger seal elements 1108 (e.g., annular seal elements) may provide one or more seals (e.g., annular seals) between the hanger 1052 and the wellhead housing 1050.

In the landed position, respective inlets of the one or more passages 1060 are positioned at a first axial location within the wellhead housing 1050 (e.g., along the axial axis 44), and respective outlets of the one or more passages 1060 are positioned at a second axial location within the wellhead housing 1050 (e.g., along the axial axis 44). Further, in the landed position, one or more running tool passages 1112 formed in the running tool 1084 may be fluidly coupled to the respective outlets of the one or more passages 1060 formed in the hanger 1052, such as via the pocket portion 1066 of the hanger 1052. Further, in the landed position, one or more seal assembly passages 1114 provided along the energizing sleeve 1070 (e.g., between the energizing sleeve 1070 and the running tool 1084 along the radial axis 46) may be fluidly coupled to the respective outlets of the one or more passages 1060 formed in the hanger 1052. Further, in the landed position, one or more additional running tool passages 1116 formed in the running tool 1084 may be fluidly coupled to the respective outlets of the one or more passages 1060 formed in the hanger 1052. As shown, in the landed position of FIG. 2, the seal body 1064 is outside of the pocket portion 1066 (e.g., axially offset from the pocket portion 1066; above the pocket portion 1066 relative to the wellbore) and does not block or cover the one or more passages 1060 (or any of the other passages 1112, 1114, 1116).

In particular, prior to running the hanger 1052 with the casing 1054 and the seal assembly 1062 into the wellhead housing 1050, the seal assembly 1062 may be coupled to the hanger 1052 via the threaded interface 1074 (e.g., via rotation in the first rotational direction). Then, the torque sleeve 1076 is coupled to the running tool 1084 (e.g., via the one or more shear pins 1086 and the one or more set screws 1088), which is then coupled to the hanger 1052 via the threaded interface 1098 (e.g., via rotation in the second rotational direction; fully threaded onto; until reaching a stop 1118). Thus, the seal assembly 1062 may be coupled to the hanger 1052 such that the seal assembly 1062 is in a first position (e.g., unsealed position) relative to the hanger 1052 as the running tool 1084 runs the hanger 1052 with the casing 1054 and the seal assembly 1062 into the wellhead housing 1050. As shown in FIG. 2, with the running tool 1084 threaded onto the hanger 1052 and with the seal assembly 1062 in the first position relative to the hanger 1052, the one or more running tool passages 1112 are axially aligned with the seal body 1064 and extend axially across the seal body 1064 (e.g., to bypass the seal body 1064).

Thus, once the hanger 1052 is in the landed position, cementing operations may commence to cement the casing within the wellbore. In this way, the one or more passages 1060, the pocket portion 1066, the one or more running tool passages 1112, the one or more seal passages 1114, and the one or more additional running tool passages 1116 provide a bypass pathway for fluid flow (e.g., cement returns; as shown by arrows 1120) between the first axial location within the wellhead housing 1050 (e.g., below the first axial location relative to the wellbore; exposed to an annular space below the hanger 1052) to a third axial location within the wellhead housing 1050 (e.g., above the first axial location relative to the wellbore; exposed to another annular space above the hanger 1052).

Then, from the landed position and after cementing operations, rotation of the running tool 1084 (e.g., in the first rotational direction) causes rotation of the torque sleeve 1076 (e.g., in the first rotational direction; with the running tool 1084) via the one or more shear pins 1086, which causes rotation of the energizing sleeve 1070 via the castellated interface 1078. As noted herein, the threaded interface 1074 between the energizing sleeve 1070 and the hanger 1052 and the threaded interface 1098 between the running tool 1084 and the hanger 1052 may be in opposite directions (e.g., first direction and second direction; right hand and left hand), and thus, the rotation of the running tool 1084 to thread off of the hanger 1052 (e.g., move axially away from the wellbore) may also cause the energizing sleeve 1070 to thread onto the hanger 1052 (e.g., move axially toward the wellbore; via rotation of the energizing sleeve 1070 imparted by the torque sleeve 1076, and more particularly, imparted by the castellated interface 1078).

FIG. 3 is a cross-sectional side view of an embodiment of the portion of the wellhead 12 of FIG. 2, wherein the hanger 1052 is in a locked position and the seal assembly 1062 is in a second position (e.g., sealed and locked position). To transition from a configuration shown in FIG. 2 to another configuration shown in FIG. 3 after cementing operations, the running tool 1084 is rotated (e.g., in the first rotation direction), which causes the torque sleeve 1076 to rotate with the running tool 1084 via the one or more shear pins 1086, which causes the energizing sleeve 1070 to rotate with the running tool 1084 and the torque sleeve 1076 via the castellated interface 1078. Due to the threaded interfaces 1074, 1098, the running tool 1084 threads off of the hanger 1052 and the energizing sleeve 1070 threads onto the hanger 1052. As the energizing sleeve 1070 threads onto the hanger 1052, the energizing sleeve 1070 drives (e.g., exerts force) the seal body 1064 toward the pocket portion 1066 of the hanger 1052 along the axial axis 44. In this way, the seal body 1064 inserts into the pocket portion 1066 such that the one or more seal elements 1068 for one or more seals (e.g., annular seals) within the pocket portion 1066 (e.g., to block the fluid flow through the pocket portion 1066 and through the one or more passages 1060). In particular, the seal body 1064 may insert into the pocket portion 1066, such that the one or more seal element 1068 contact and seal against respective annular surfaces that defines the pocket portion 1066 and cover the one or more passages 1060. In certain embodiments, the pocket portion 1066 may include or define a pocket shoulder 1095 (e.g., axially facing surface; tapered surface) that supports the seal body 1064 in the sealed position and/or facilitates formation of the seal between the seal body 1064 and the hanger 1052.

When the seal body 1064 is fully inserted (e.g., reaches the sealed position) and/or when the energizing sleeve 1070 is fully threaded onto the hanger 1052 via the threaded interface 1074, the energizing sleeve 1070 is blocked from further rotation (e.g., in the first direction). Due to the castellated interface 1078, the torque sleeve 1076 is also blocked from further rotation when the energizing sleeve 1070 is blocked from further rotation. Accordingly, further rotation of the running tool 1084 then causes the one or more shear pins 1086 to shear to enable the running tool 1084 to rotate relative to the torque sleeve 1076. However, as the further rotation of the running tool 1084 continues to unthread the running tool 1084 from the hanger 1052, the one or more set screws 1088 cause the running tool 1084 to drive (e.g., pull) the torque sleeve 1076 with the running tool 1084 along the axial axis 44. Further, the castellated interface 1078 permits the torque sleeve 1076 to move relative to the seal assembly 1062 along the axial axis 44. Thus, the running tool 1084 and the torque sleeve 1076 may continue to move away from and withdraw from the hanger 1052, the seal assembly 1062, and the wellbore along the axial axis 44.

As shown in FIG. 3, as the energizing sleeve 1070 threads onto the hanger 1052, the energizing sleeve 1070 may also contact and drive the lock ring 1100 radially outwardly to engage a lock groove 1130 (e.g., annular lock groove) formed in the wellhead housing 1050 to thereby lock the hanger 1052 within the wellhead housing 1050. Thus, the hanger 1052 may be considered to be in the locked position within the wellhead housing 1050.

Figure 4:
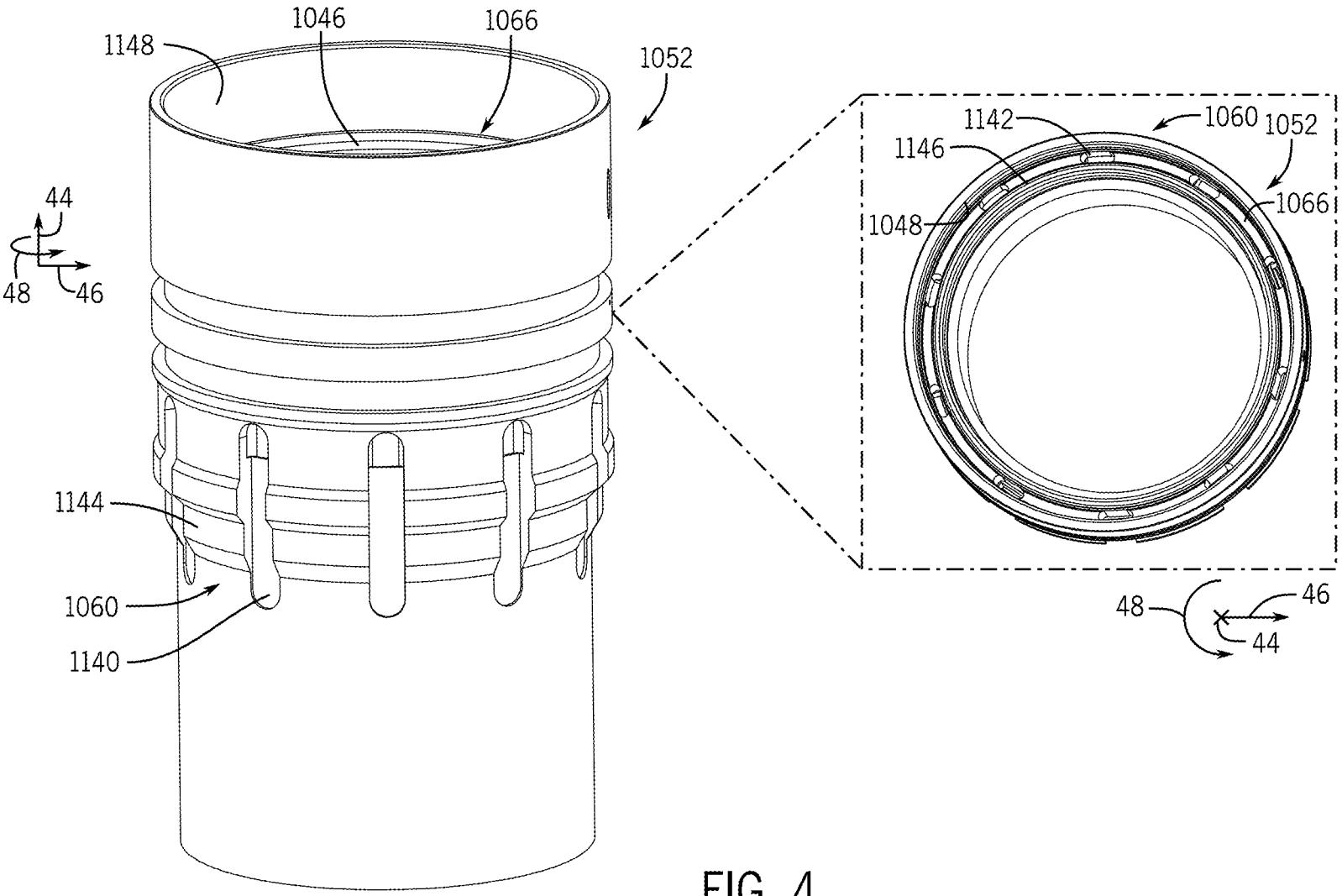
FIG. 4 is a perspective view of an embodiment the hanger of FIG. 2.

As noted, FIGS. 4-7 are various views of components that may be utilized in the portion of the wellhead 12 of FIGS. 2 and 3. With this in mind, FIG. 4 is a perspective view of an embodiment the hanger 1052. Additionally, FIG. 4 includes an inset that shows a top perspective view of the hanger 1052. As shown, the hanger 1052 includes the one or more passages 1060 and the pocket portion 1066. The one or more passages 1060 may include one or more grooves 1140 (e.g., open grooves; groove portions) that extend into one or more holes 1142 (e.g., openings; through holes; hole portions). For example, the one or more grooves 1140 may be recesses formed in a radially outer surface 1144 (e.g., a radially outer surface of a radially outer wall) of the hanger 1052, and the one or more holes 1142 may extend through and/or be defined radially between the radially outer surface 1144 of the hanger 1052 and a first radially inner surface 1146 (e.g., a radially inner surface of a radially inner wall) of the hanger 1052. The hanger 1052 may include corresponding threads on the first radially inner surface 1146 of the hanger 1052 (e.g., to couple the hanger 1052 to the running tool 1084 via the threaded interface 1098 as shown in FIG. 2). Further, the hanger 1052 may include corresponding threads on a second radially inner surface 1148 (e.g., a radially inner surface of the radially outer wall) of the hanger 1052 (e.g., to couple the hanger 1052 to the energizing sleeve 1070 via the threaded interface 1074 as shown in FIG. 2). The pocket portion 1066 may be defined radially between the first radially inner surface 1146 (e.g., the radially inner wall) and the second radially inner surface 1148 (e.g., the radially outer wall). To facilitate discussion, the one or more grooves 1140, the one or more holes 1142, the radially outer surface 1144, the first radially inner surface 1146, and the second radially inner surface 1148 are also labeled in FIG. 2.

Figure 5:
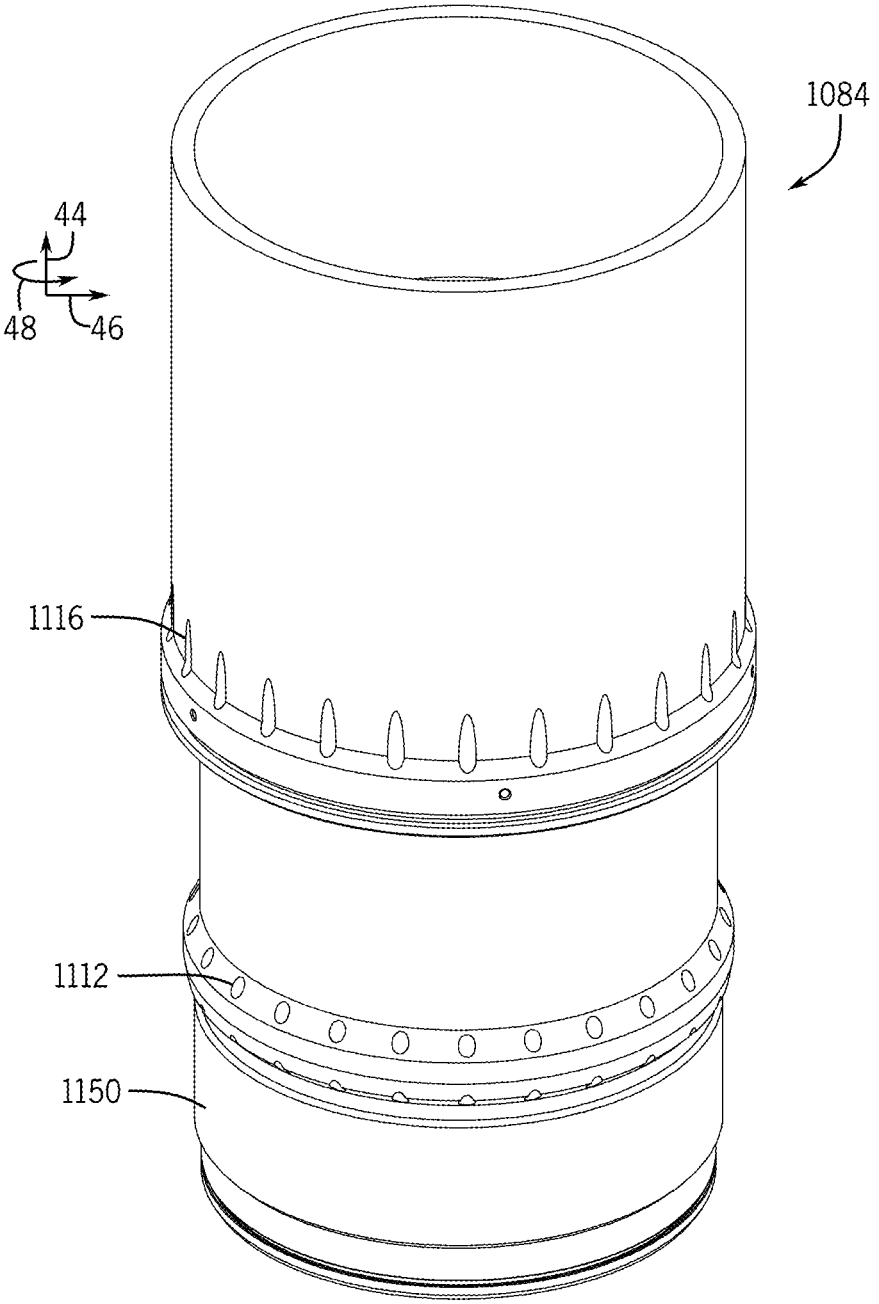
FIG. 5 is a perspective view of an embodiment a running tool that may be utilized to run the hanger of FIG. 2.

FIG. 5 is a perspective view of an embodiment the running tool 1084 that may be utilized to run the hanger 1052 of FIG. 2. The running tool 1084 may include the one or more running tool passages 1112 formed in the running tool 1084. Additionally, the running tool 1084 may include the one or more additional running tool passages 1116. The running tool 1084 may also include threads on a radially outer surface 1150 of the running tool 1084 (e.g., to couple the running tool 1084 to the hanger 1052 via the threaded interface 1098 as shown in FIG. 2). To facilitate discussion, the radially outer surface 1150 is also labeled in FIG. 2.

Figure 6:
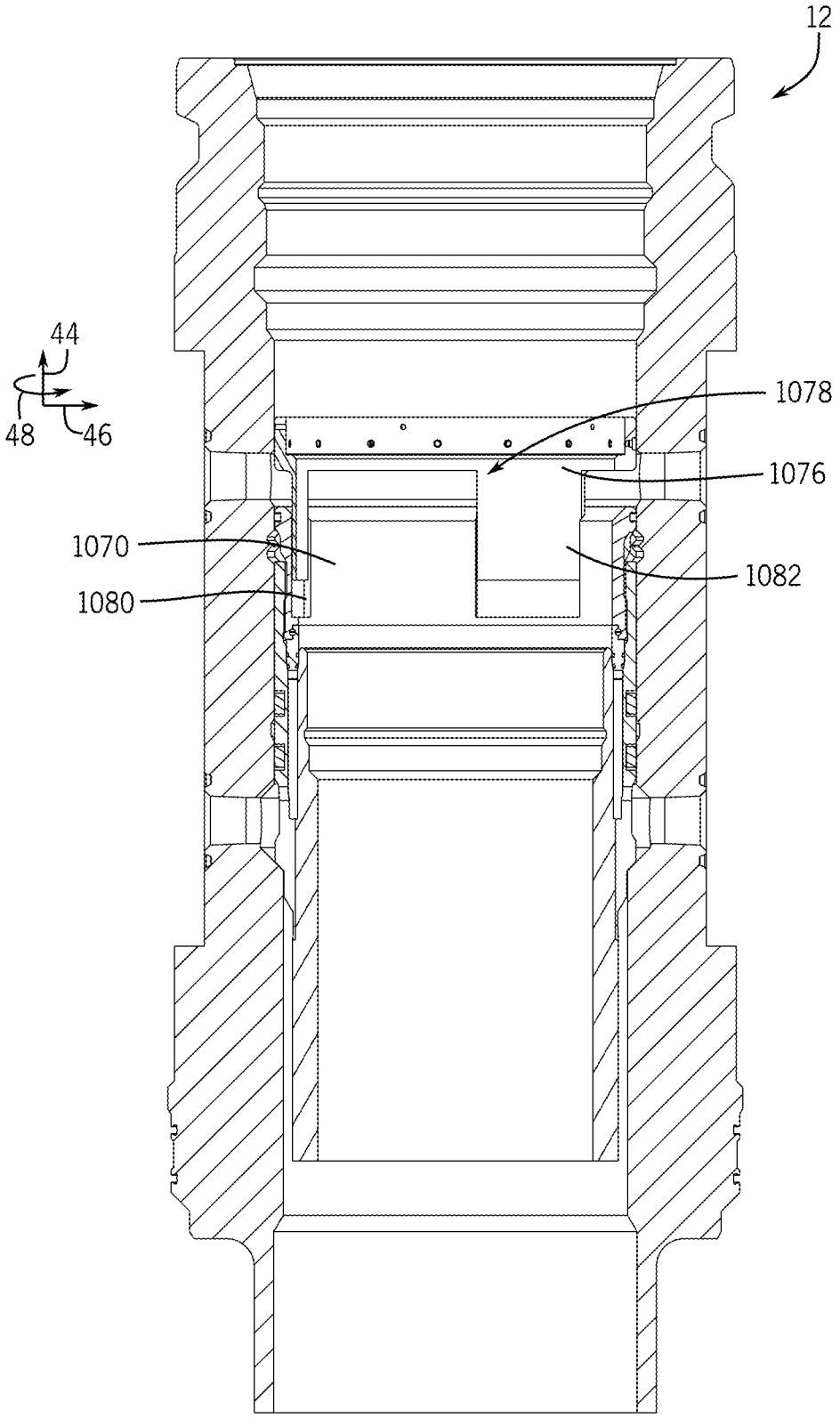
FIG. 6 is a cross-sectional side view of an embodiment of a portion of the wellhead of FIG. 2, wherein the running tool is withdrawn to show engagement between a torque sleeve and an energizing sleeve of a seal assembly.

FIG. 6 is a cross-sectional side view of an embodiment of a portion of the wellhead 12 of FIG. 2, wherein the running tool 1084 is not shown in order to illustrate the engagement between the torque sleeve 1076 and the energizing sleeve 1070. In particular, the torque sleeve 1076 and the energizing sleeve 1070 are coupled (e.g., non-rotatably; rotationally locked; axially free) via the castellated interface 1078. As shown, the castellated interface 1078 may be formed with the one or more grooves 1080 formed in the radially inner surface of the energizing sleeve 1070 that receive the one or more extensions 1082 of the torque sleeve 1076.

When coupled together in this way, the one or more extensions 1082 of the torque sleeve 1076 overlap with portions of the energizing sleeve 1070 (e.g., side walls that define the one or more grooves 1080) along the axial axis 44 and along the radial axis 46. Accordingly, when engaged, the castellated interface 1078 enables rotation of the torque sleeve 1076 to drive rotation of the energizing sleeve 1070 (e.g., via contact between the side walls that define the one or more grooves 1080 of the energizing sleeve 1070 and corresponding side walls of the one or more extensions 1082 of the torque sleeve 1076; blocks rotation of the torque sleeve 1076 relative to the energizing sleeve 1070 in the circumferential direction 48). For example, the castellated interface 1078 enables rotation of the torque sleeve 1076 in the first direction to drive rotation of the energizing sleeve 1070 in the first direction, as well as rotation of the torque sleeve 1076 in a second direction to drive rotation of the energizing sleeve 1070 in the second direction. Further, even when engaged, the castellated interface 1078 enables movement of the torque sleeve 1076 relative to the energizing sleeve 1070 along the axial axis 44.

Figure 7:
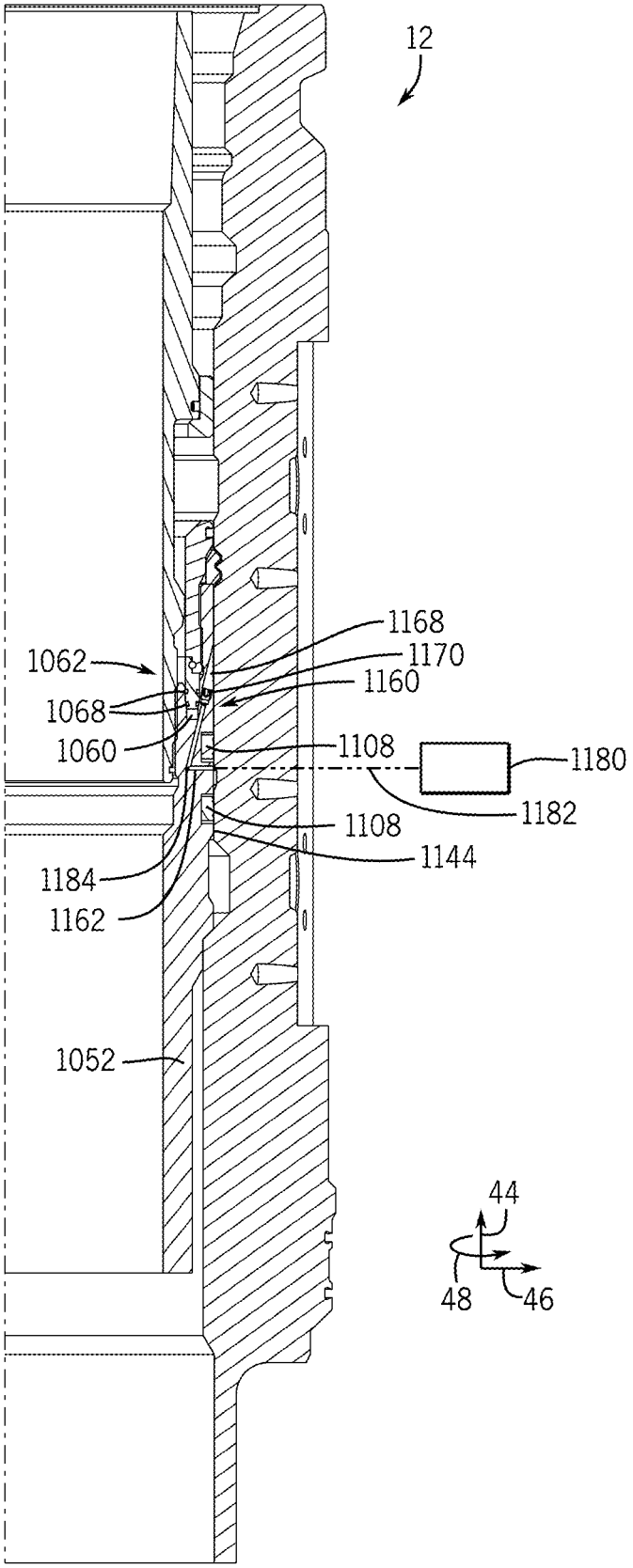
FIG. 7 is a cross-sectional side view of an embodiment of a portion of the wellhead of FIG. 2, wherein a test port is provided in the hanger.

FIG. 7 is a cross-sectional side view of an embodiment of a portion of the wellhead 12 of FIG. 2, wherein a test port 1160 is provided in the hanger 1052. One or more passages 1162 (e.g., radially, axially, and/or circumferentially extending passages; channels), are formed or provided in the hanger 1052 to fluidly couple a first space (e.g., annular space) between the one or more hanger seal elements 1108, and a second space (e.g., annular space) between the one or more seal elements 1068 to create the test port 1160.

As shown, an access port 1168 extends from the radially outer surface 1144 of the hanger 1052 to the one or more passages 1162. Additionally, a plug 1170 is inserted into the access port 1168 to seal the access port 1168. The access port 1168 may enable formation the one or more passages 1162 during manufacturing with certain techniques (e.g., drilling into the hanger 1052 from the radially outer surface 1144 of the hanger 1052). However, it should be appreciated that the one or more passages 1162 may be formed without the access port 1168 (e.g., the access port 1168 may not be provided; the hanger 1052 is devoid of the access port 1168) during manufacturing with other techniques (e.g., additive manufacturing, such as three-dimensional (3D) printing)).

The test port 1160 may be fluidly coupled to an external fluid source 1180 (e.g., hydraulic fluid source; pump, such as a hand pump) via a wellhead connector 1182 (e.g., passage and fitting, such as autoclave fitting). The test port 1160 may include an internal rupture disc 1184 (e.g., positioned in the one or more passages 1162) that adjusts (e.g., ruptures, breaks) from a closed position to an open position. In the closed position, the internal rupture disc 1184 blocks fluid flow across the internal rupture disc 1184 to enable a first pressure test of the one or more hanger seal elements 1108. Then, via overpressure from the external fluid source 1180, the internal rupture disc 1184 may transition from the closed position to the open position in which the internal rupture disc 1184 enables fluid flow across the internal rupture disc 1184 to enable a second pressure test of the one or more seal elements 1068. In operation, the first pressure test of the one or more hanger seals elements 1108 may be carried out after the hanger 1052 reaches the landed position. Then, the second pressure test of the one or more seal elements 1068 may be carried out after the seal assembly 1062 is placed in the sealed position. In this way, the test port 1160 (e.g., a single test port with one wellhead connector 1182) may be utilized to test both the one or more hanger seals elements 1108 and the one or more seal elements 1068 at different, appropriate times during installation of the hanger 1052 at the wellhead 12.

Figure 8:
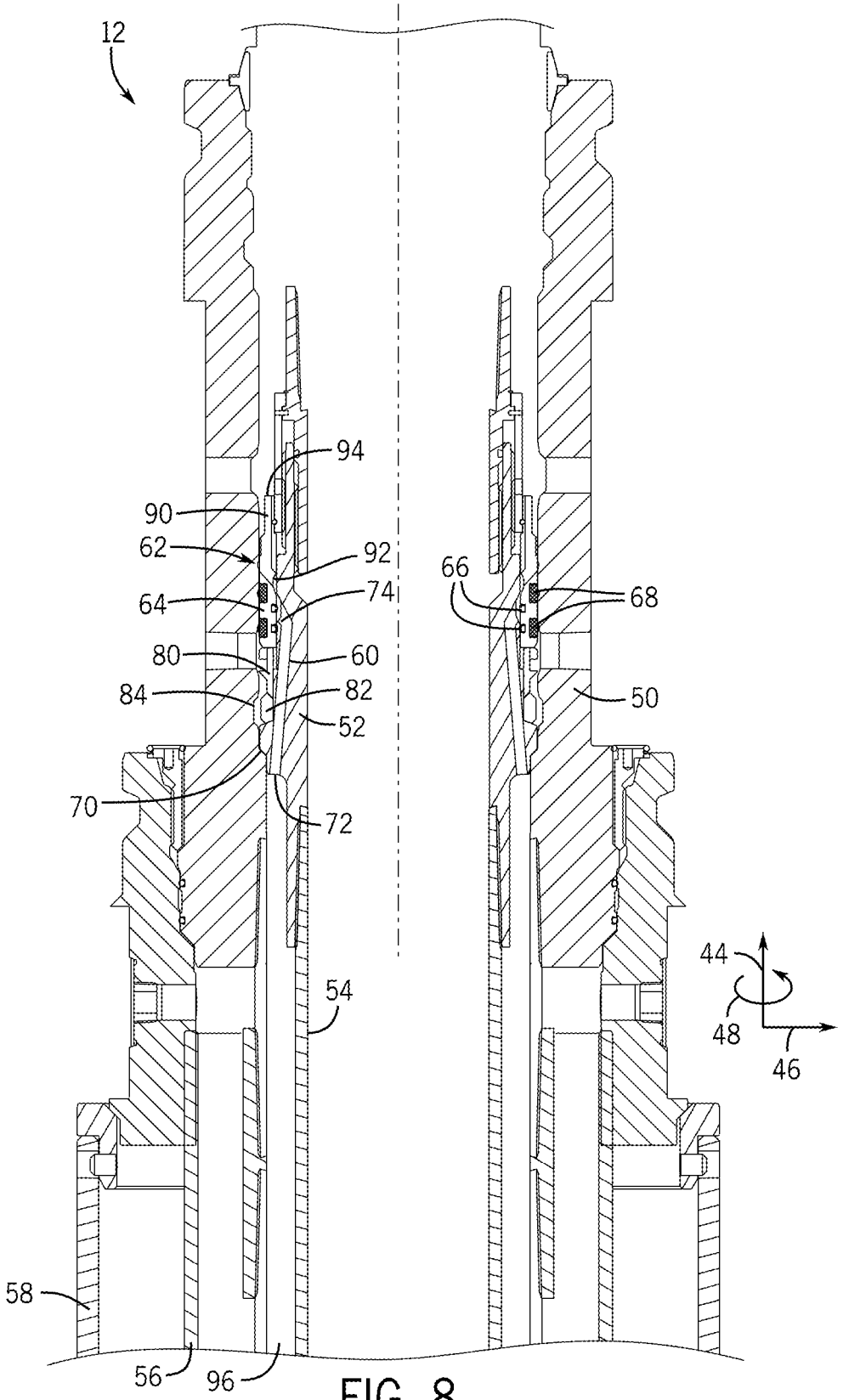
FIG. 8 is a cross-sectional side view of an embodiment of a portion of a wellhead that may be utilized in the mineral extraction system of FIG. 1, wherein a hanger includes one or more passages and is in a landed position.
Figure 9:
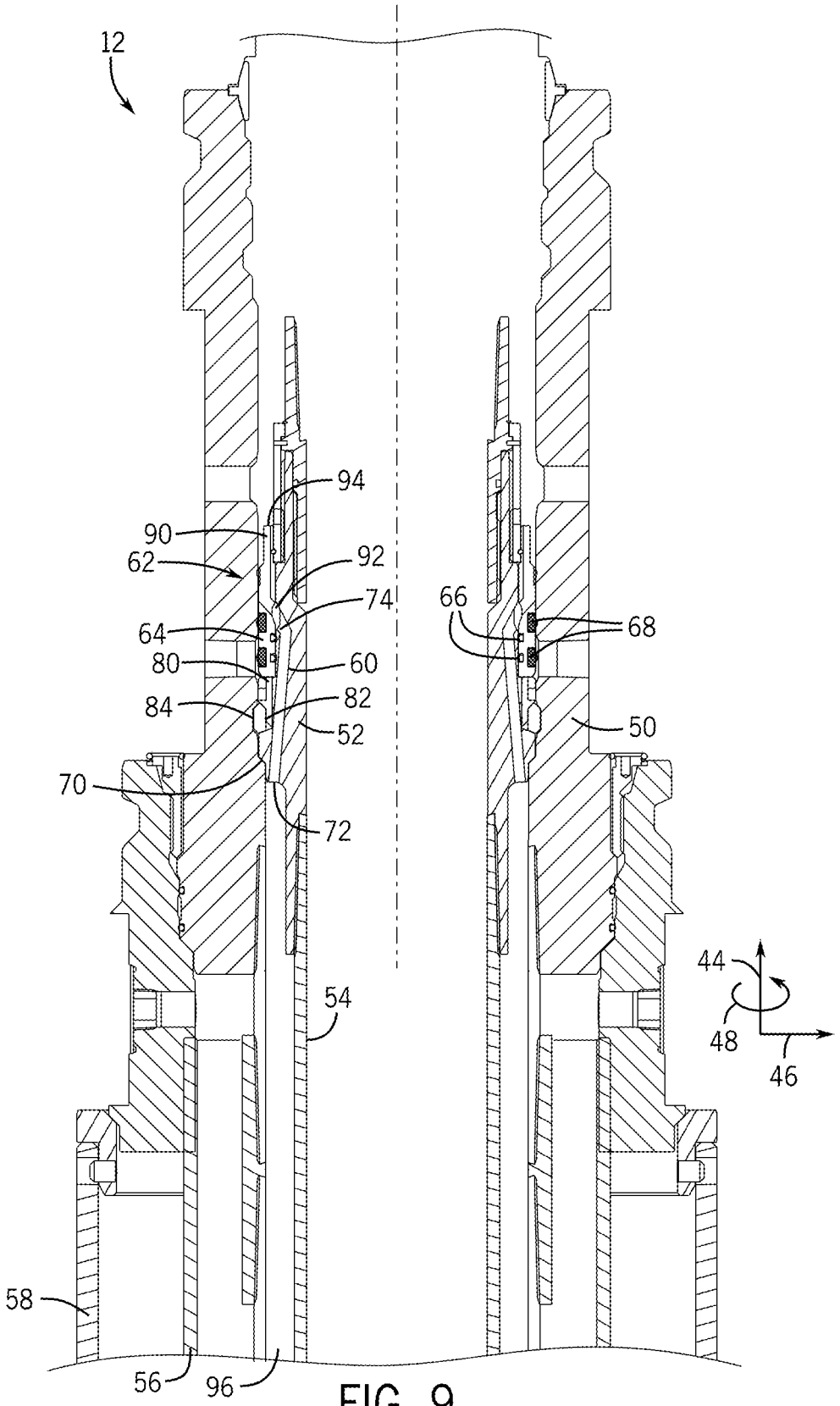
FIG. 9 is a cross-sectional side view of an embodiment of the portion of the wellhead of FIG. 8, wherein the hanger is in a locked position.
Figure 10:
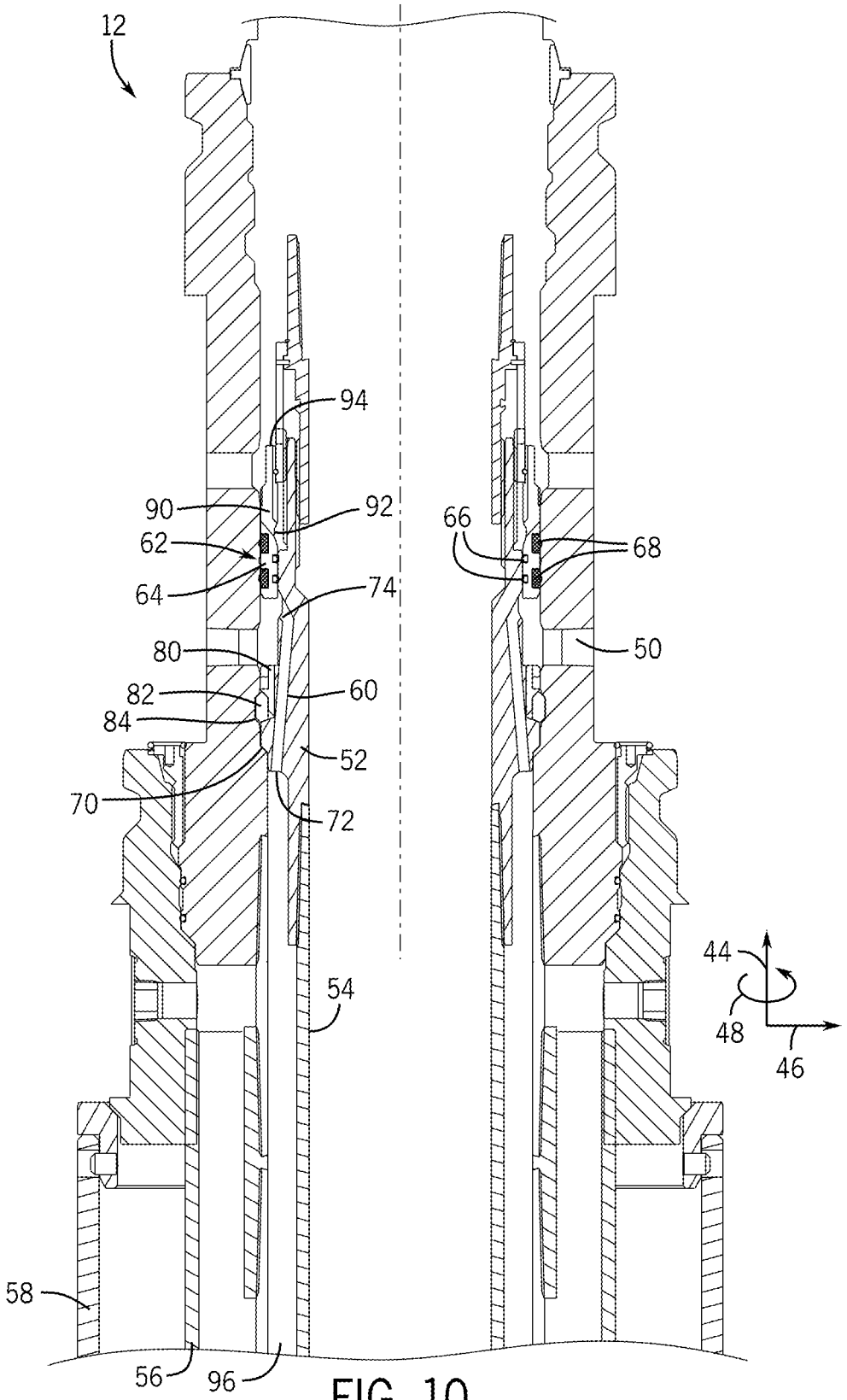
FIG. 10 is a cross-sectional side view of an embodiment of the portion of the wellhead of FIG. 8, wherein the hanger is in a sealed position.

FIGS. 8-10 are cross-sectional side views of an embodiment of a portion of the wellhead 12. As shown, the portion of the wellhead 12 includes a wellhead housing 50 (e.g., a portion of a casing spool, such as a portion of the casing spool 26 of FIG. 1) and a hanger 52 (e.g., a casing hanger, such as the casing hanger 36 of FIG. 1). The hanger 52 is positioned in the wellhead housing 50 and suspends a casing 54 that extends into a wellbore. For example, the casing 54 may pass through one or more additional casings 56 and/or a conductor 58 to extend into the wellbore. The hanger 52 includes one or more passages 60 (e.g., axial passages).

A seal assembly 62 (e.g., annular seal assembly) is positioned about a portion of the hanger 52. As shown, the seal assembly 62 may include a seal body 64 (e.g., annular seal body; ring; a one-piece, solid body) that defines one or more inner seal grooves (e.g., annular seal grooves) that support one or more inner seal elements 66 (e.g., annular seal elements). Additionally, the seal assembly 62 may include the seal body 64 that defines one or more outer seal grooves (e.g., annular seal grooves) that support one or more outer seal elements 68 (e.g., annular seal elements).

Figure 14:
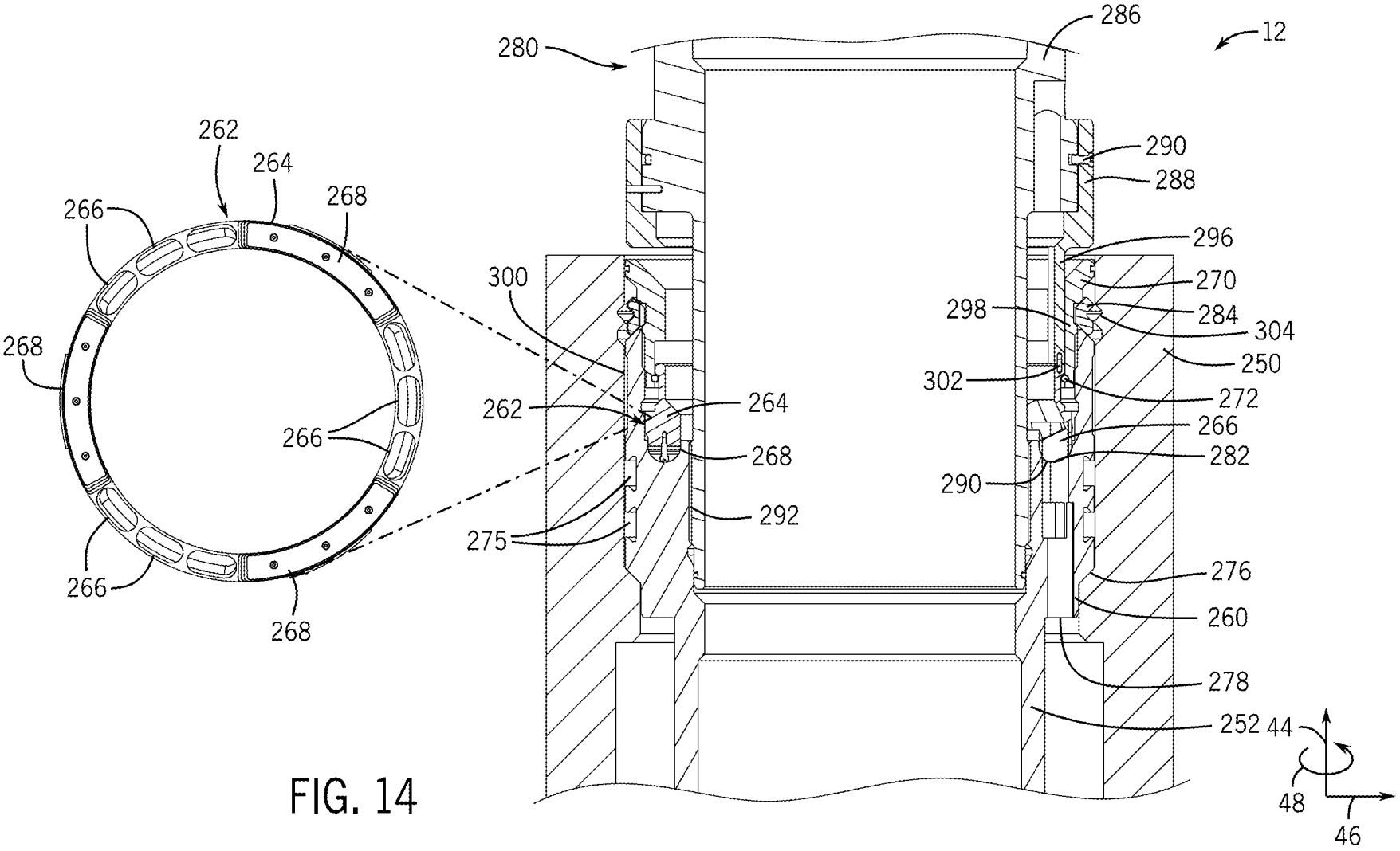
FIG. 14 is a cross-sectional side view of an embodiment of a wellhead that may be utilized in the mineral extraction system of FIG. 1, wherein a hanger includes one or more passages and is in a landed position.

In operation, a running tool may lower the hanger 52 with the casing 54 and the seal assembly 62 into the wellhead housing 50. With reference to FIG. 14, the running tool may lower the hanger 52 until the hanger 52 reaches a landed position in which the hanger 52 is landed on the wellhead housing 50 (e.g., axially facing or radially overlapping surfaces contact one another at an interface 70 to block further movement of the hanger 52 relative to the wellhead housing 50 toward the wellbore). In the landed position, respective inlets 72 of the one or more passages 60 are positioned at a first axial location within the wellhead housing 50 (e.g., along the axial axis 44), and respective outlets 74 of the one or more passages 60 are positioned at a second axial location within the wellhead housing 50 (e.g., along the axial axis 44).

Additionally, in the landed position, the seal assembly 62 may contact and seal against the hanger 52 via the one or more inner seal elements 66, and/or the seal assembly 62 may contact and seal against the wellhead housing 50 via the one or more outer seal elements 68. Further, in the landed position, at least a portion of the seal assembly 62 may be at or proximate to the second axial location within the wellhead housing 50 to block (e.g., cover) the respective outlets 74 of the one or more passages 60 formed in the hanger 52.

Figure 15:
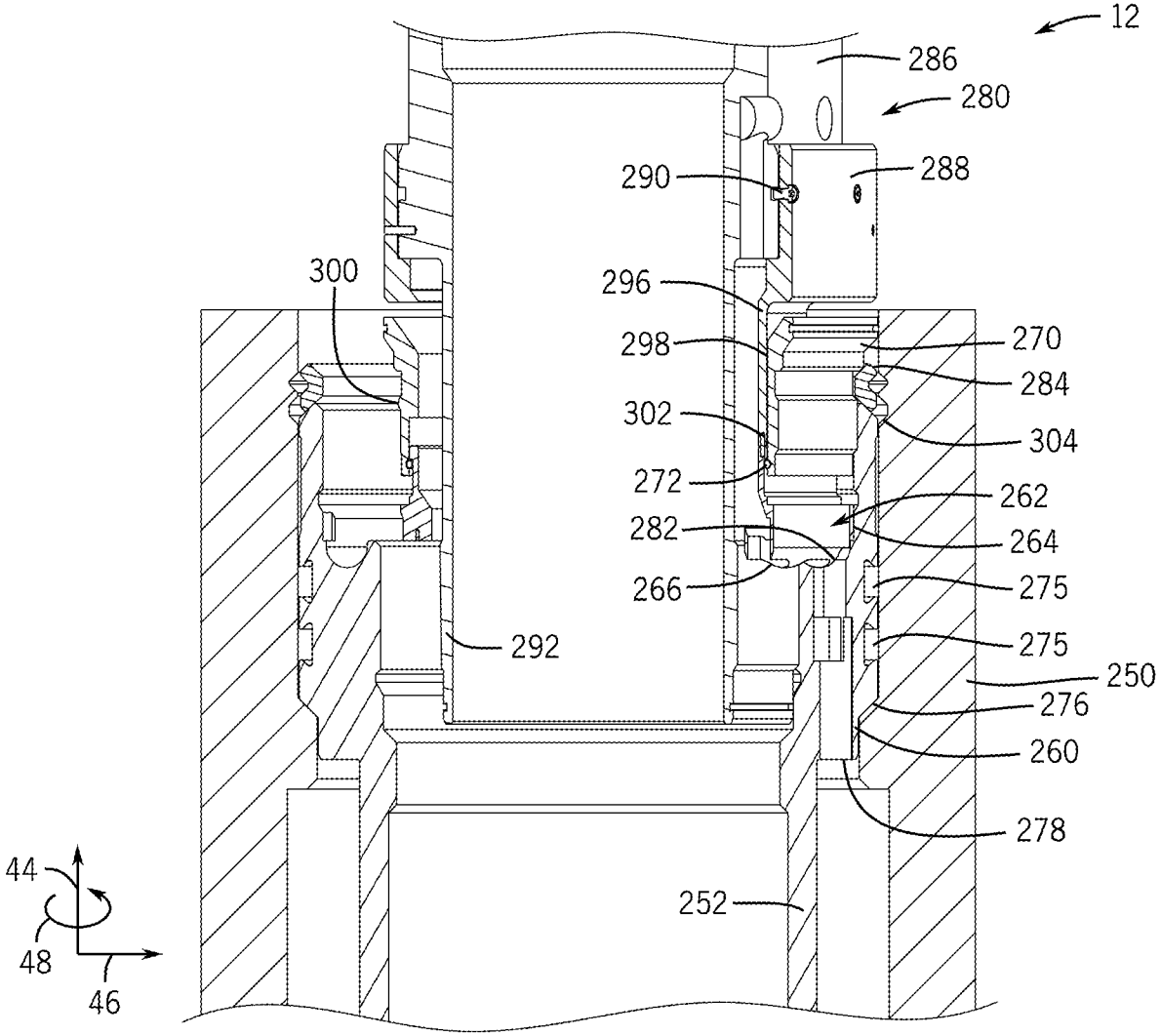
FIG. 15 is a cross-sectional side view of an embodiment of the portion of the wellhead of FIG. 14, wherein rotation of a running tool drives rotation of a seal assembly relative to the hanger.
Figure 16:
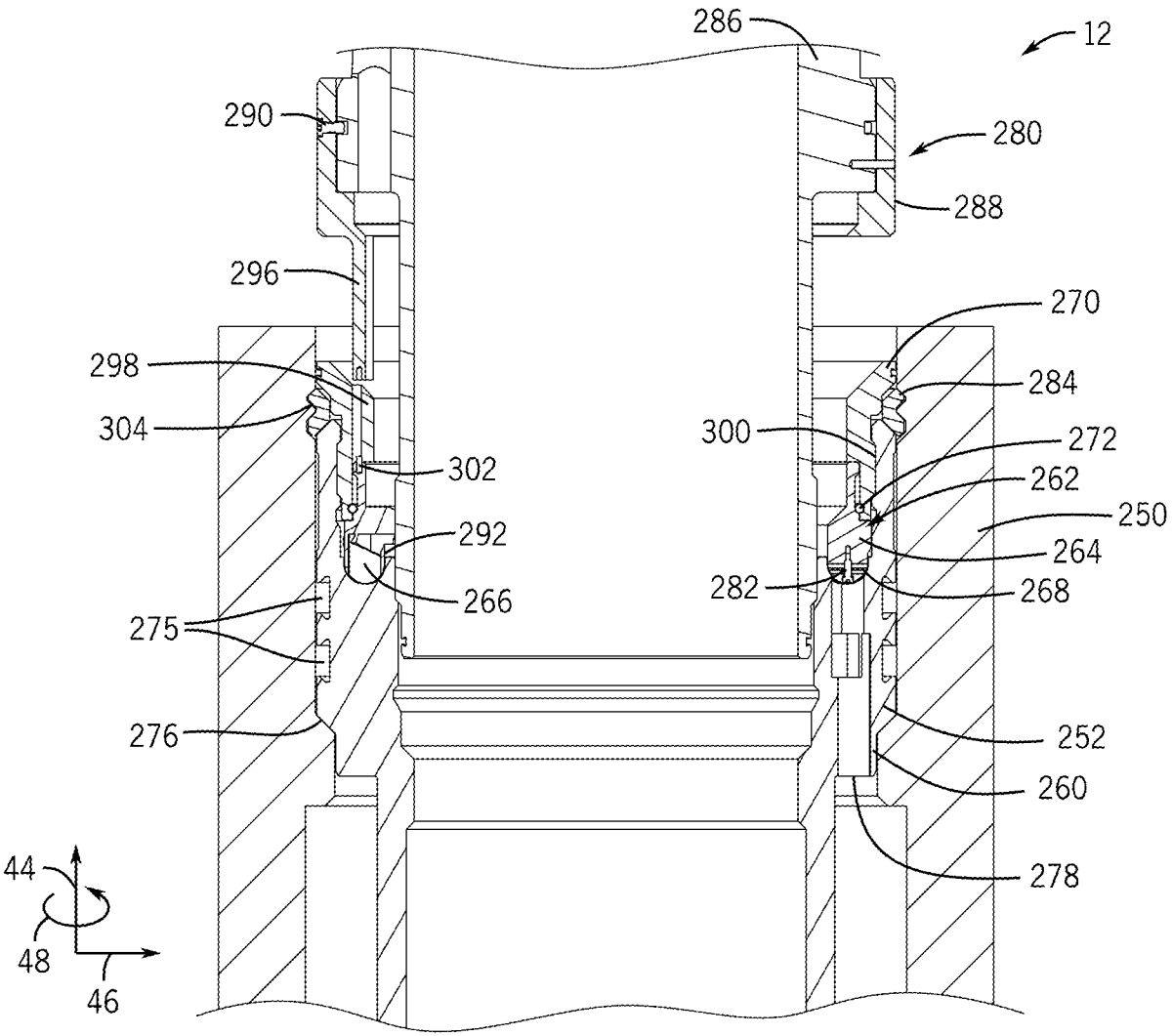
FIG. 16 is a cross-sectional side view of an embodiment of the portion of the wellhead of FIG. 14, wherein the hanger is in a sealed and locked position.

With reference to FIG. 15, from the landed position, the running tool may continue to drive (e.g., push) the seal assembly 62 axially toward the wellbore and relative to the hanger 52. As shown, the seal assembly 62 may contact and drive a push ring 80 (e.g., annular ring) axially toward the wellbore, which may cause the push ring 80 to drive a lock ring 82 (e.g., c-ring) radially outwardly to engage a groove 84 (e.g., annular groove) formed in the wellhead housing 50 to thereby lock the hanger 52 within the wellhead housing 50. Thus, the hanger 52 may be considered to be in a locked position within the wellhead housing 50.

In the locked position, one or more seal passages 90 formed in or through the seal assembly 62 may be fluidly coupled to the one or more passages 60 formed in the hanger 52. In particular, respective inlets 92 of the one or more seal passages 90 may be at the second axial location to align (e.g., axially and/or circumferentially; in some cases, an undercut or gap in the hanger 52 and/or the seal assembly 62 may fluidly couple passages 60, 90 that are not aligned circumferentially) with the respective outlets 74 of the one or more passages 60, and respective outlets 94 of the one or more seal passages 90 may be at a third axial location to thereby enable a fluid (e.g., cement returns; drilling mud that is displaced during cementing operations) to flow from the respective inlets 72 of the one or more passages 60 to the respective outlets 94 of the one or more seal passages 90.

Once the hanger 52 is in the locked position, the cementing operations may commence to cement the casing 54 within the wellbore. In particular, the fluid may travel into the respective inlets 72, through the one or more passages 60, through the one or more seal passages 90, and out from the respective outlets 94. In this way, the one or more passages 60 and the one or more seal passages 90 provide a bypass pathway for fluid flow between the first axial location within the wellhead housing 50 (e.g., below the first axial location relative to the wellbore; exposed to an annular space below the hanger 52) to the third axial location within the wellhead housing 50 (e.g., above the first axial location relative to the wellbore; exposed to another annular space above the hanger 52).

With reference to FIG. 10, from the locked position and after cementing operations, the seal assembly 62 is configured to move axially away from the wellbore and relative to the wellhead housing 50 (e.g., along the axial axis 44) to selectively seal the one or more passages 60 (and more generally to seal the annular space or a bore 96 below the hanger 52). Thus, the hanger 52 may be considered to be in a sealed position within the wellhead housing 50.

For example, the running tool may drive (e.g., pull) the seal assembly 62 to a fourth axial location that is above the respective outlets 74 of the one or more passages 60 relative to the wellbore to thereby block the fluid flow across the hanger 52. In particular, the seal assembly 62 may contact and seal against the hanger 52 via the one or more inner seal elements 66, and the seal assembly 62 may contact and seal against the wellhead housing 50 via the one or more outer seal elements 68. Thus, the seal assembly 62 seals the annular space between a radially outer surface of the hanger 52 and a radially inner surface of the wellhead housing 50.

It should be appreciated that the running tool may be coupled to the hanger 52 and/or the seal assembly 62 via any suitable coupling techniques. For example, the running tool may be coupled to the hanger 52 via a respective threaded interface, and the running tool may be coupled to the seal assembly 62 via a respective threaded interface, such that axial movement of the running tool causes axial movement of the hanger 52 and the seal assembly 62, while rotational movement of the running tool with the hanger 52 in the locked position causes axial movement of the seal assembly 62 relative to the hanger 52.

Figure 11:
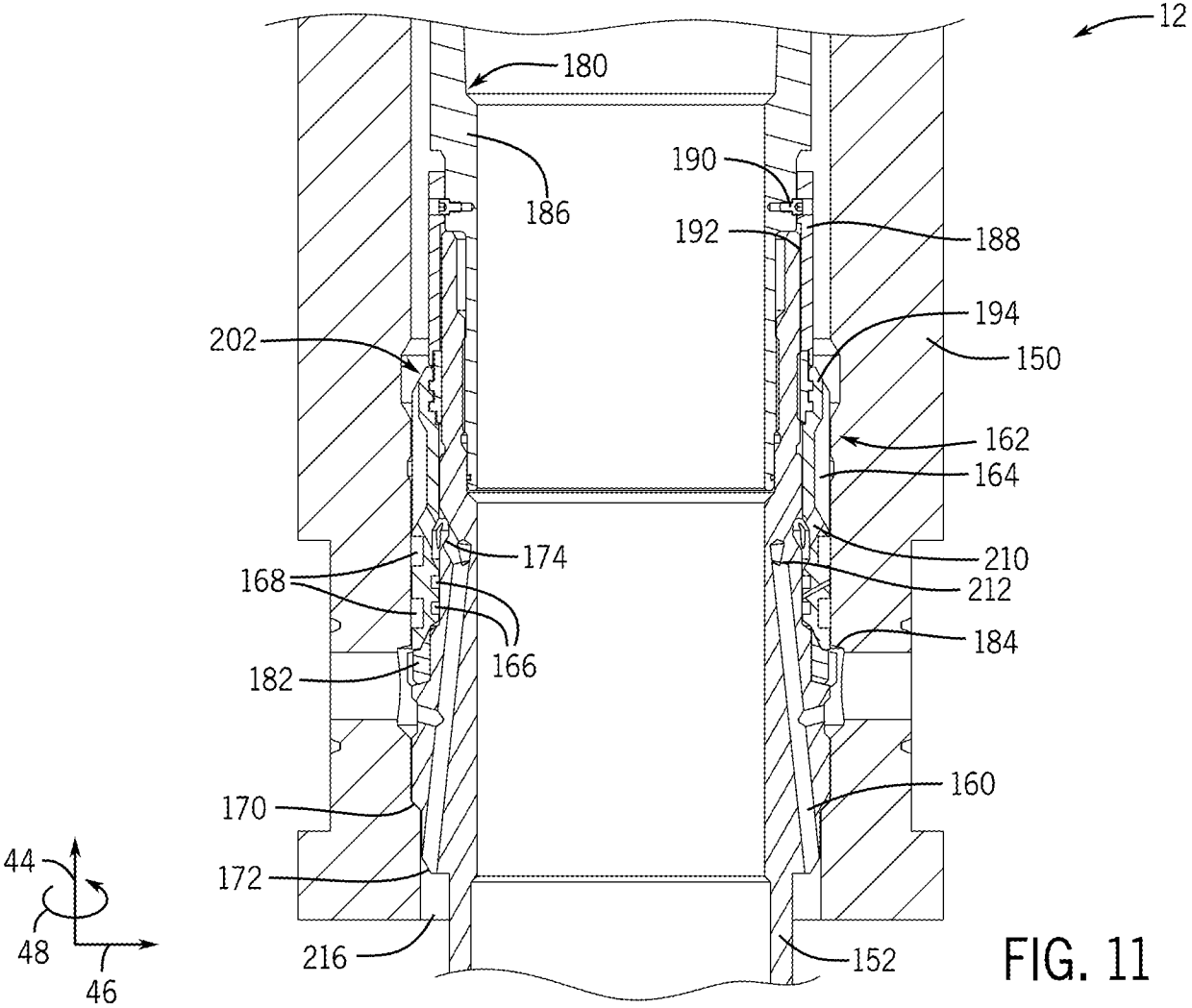
FIG. 11 is cross-sectional side view of an embodiment of a wellhead that may be utilized in the mineral extraction system of FIG. 1, wherein a hanger includes one or more passages and is in a landed position.
Figure 12:
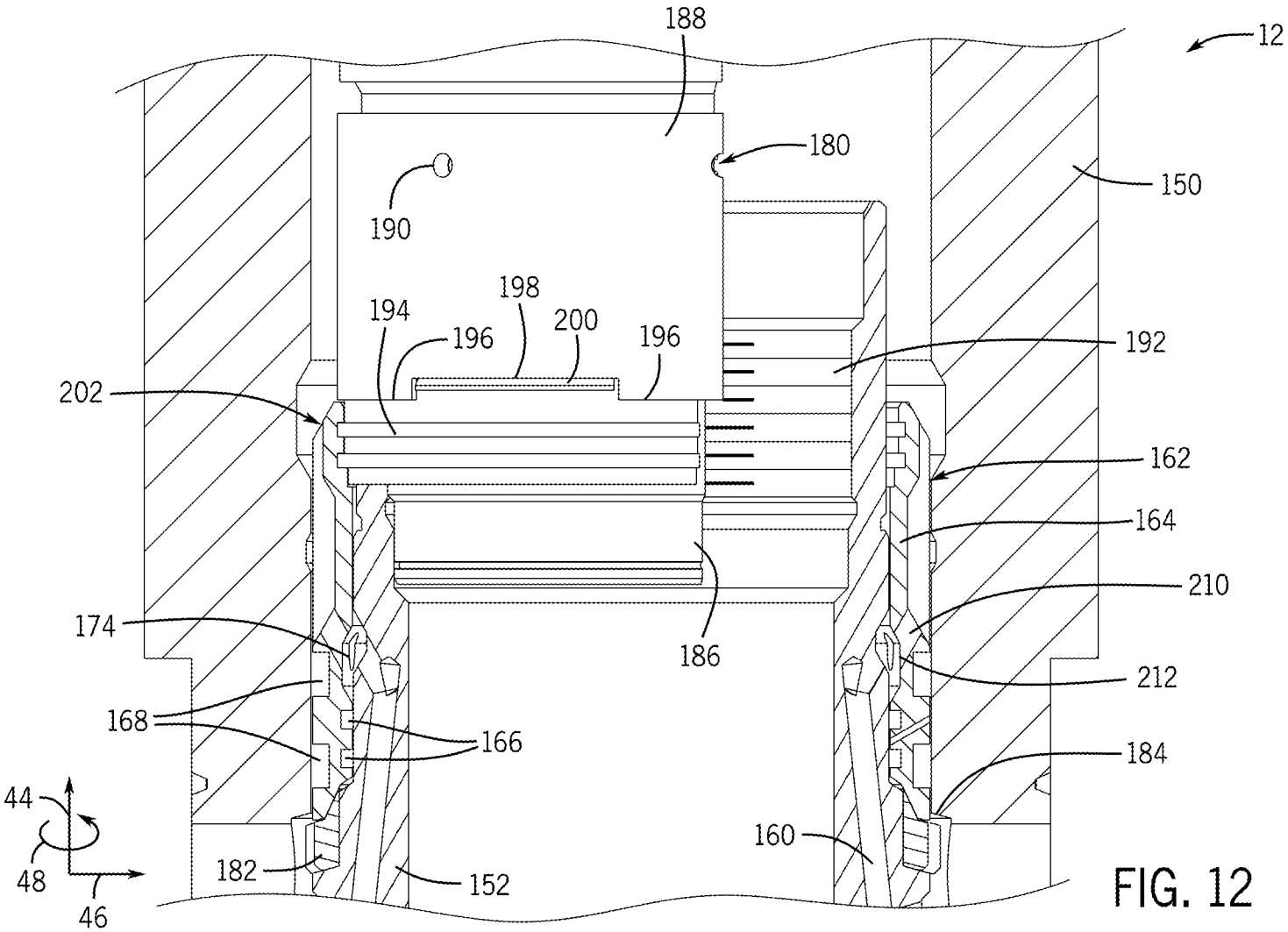
FIG. 12 is a cross-sectional side view of an embodiment of the portion of the wellhead of FIG. 11, wherein rotation of a running tool drives axial movement of a seal assembly relative to the hanger.
Figure 13:
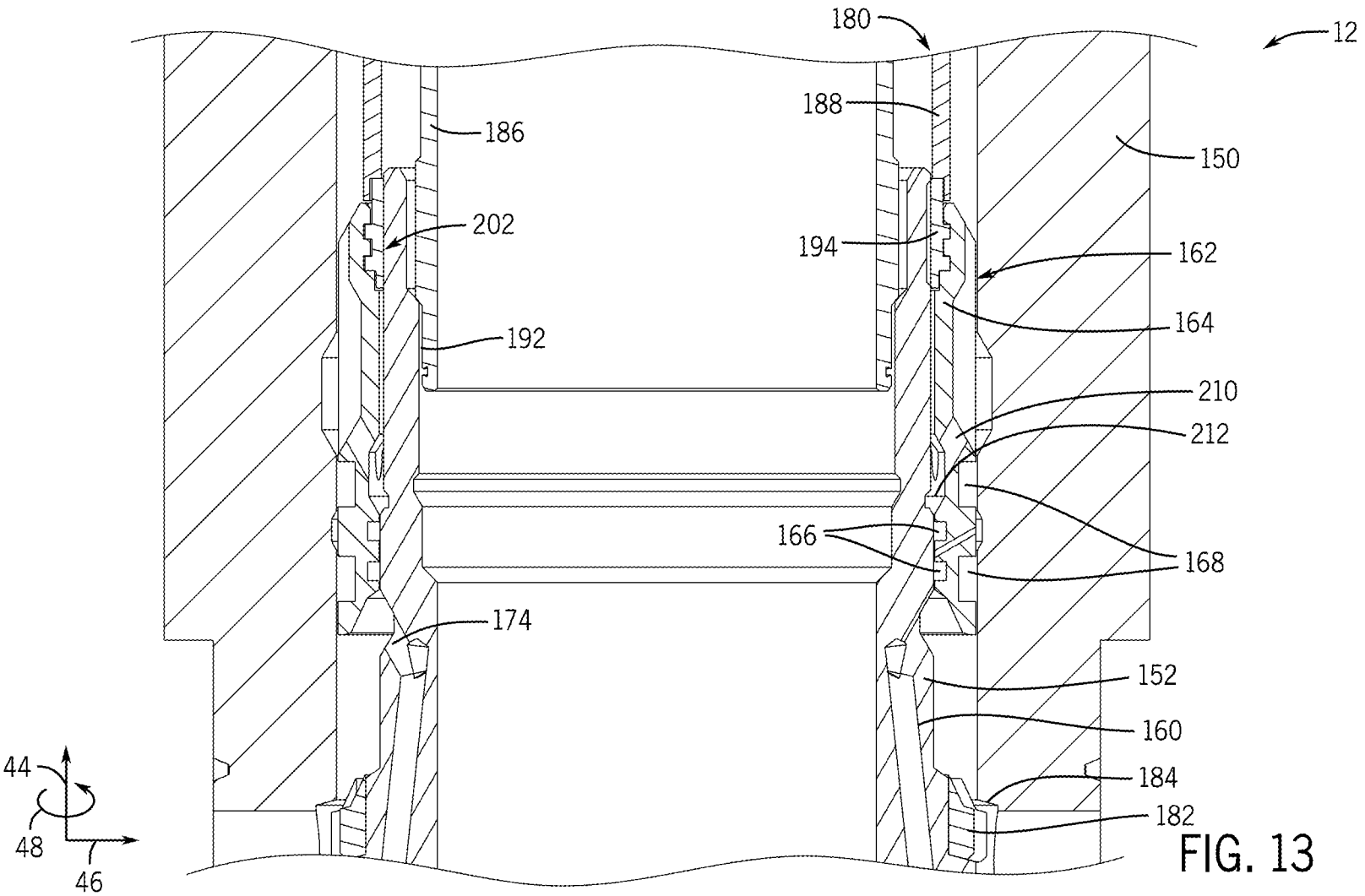
FIG. 13 is a cross-sectional side view of an embodiment of the portion of the wellhead of FIG. 11, wherein the hanger is in a sealed position.

FIGS. 11-13 are cross-sectional side views of an embodiment of a portion of the wellhead 12. As shown, the portion of the wellhead 12 includes a wellhead housing 150 (e.g., a portion of a casing spool, such as a portion of the casing spool 26 of FIG. 1) and a hanger 152 (e.g., a casing hanger, such as the casing hanger 36 of FIG. 1). The hanger 152 is positioned in the wellhead housing 150 and is configured to suspend a casing that extends into a wellbore. The hanger 152 includes one or more passages 160 (e.g., axial passages).

A seal assembly 162 (e.g., annular seal assembly) is positioned about a portion of the hanger 152. As shown, the seal assembly 162 may include a seal body 164 (e.g., annular seal body; ring; a one-piece, solid body) that defines one or more inner seal grooves (e.g., annular seal grooves) that support one or more inner seal elements 166 (e.g., annular seal elements). Additionally, the seal assembly 162 may include the seal body 164 that defines one or more outer seal grooves (e.g., annular seal grooves) that support one or more outer seal elements 168 (e.g., annular seal elements).

In operation, a running tool 180 may lower the hanger 152 with the casing and the seal assembly 162 into the wellhead housing 150. With reference to FIG. 11, the running tool 180 may lower the hanger 152 until the hanger 152 reaches a landed position in which the hanger 152 is landed on the wellhead housing 150 (e.g., axially facing or radially overlapping surfaces contact one another at an interface 170 to block further movement of the hanger 152 relative to the wellhead housing 150 toward the wellbore). In the landed position, respective inlets 172 of the one or more passages 160 are positioned at a first axial location within the wellhead housing 150 (e.g., along the axial axis 44), and respective outlets 174 of the one or more passages 160 are positioned at a second axial location within the wellhead housing 150 (e.g., along the axial axis 44).

Additionally, during running operations toward the landed position and in the landed position, the seal assembly 162 may contact and hold a lock ring 182 (e.g., c-ring) to block radial expansion of the lock ring 182. Further, in the landed position, a portion of the seal body 164 of the seal assembly 162 may be at or proximate to the second axial location within the wellhead housing 150 to block (e.g., cover) the respective outlets 174 of the one or more passages 160 formed in the hanger 152.

With reference to FIG. 12, from the landed position, the running tool 180 may drive (e.g., pull) the seal assembly 162 axially away from the wellbore and relative to the hanger 152. As shown, the seal assembly 162 may separate from the lock ring 182, which may cause the lock ring 182 to expand radially outwardly to engage a groove 184 (e.g., annular groove) formed in the wellhead housing 150 to thereby lock the hanger 152 within the wellhead housing 150. Thus, the hanger 152 may be considered to be in a locked position within the wellhead housing 150.

It should be appreciated that the running tool 180 may couple to the hanger 152 and the seal assembly 162 via any of a variety of types of connections that enable operations described herein. In FIGS. 11-13, the running tool 180 includes a tool body 186 (e.g., annular body) and an outer ring 188 (e.g., annular ring). The tool body 186 and the outer ring 188 are coupled (e.g., fixed) together via one or more fasteners 190 (e.g., pins). The tool body 186 is coupled (e.g., threadably) to the hanger 152 via a threaded interface 192 (e.g., respective threads on a radially outer surface of the tool body 186 threadably couple to respective threads on a radially inner surface of the hanger 152). The outer ring 188 is coupled (e.g., non-rotatably; rotationally locked; axially free) to a push/pull ring 194 (e.g., annular ring) of the seal assembly 162. In particular, with reference to FIG. 12, the outer ring 188 includes extensions 196 (e.g., axial extension; teeth) and recesses 198 (e.g., axial recesses; grooves) distributed circumferentially about the outer ring 188 (e.g., in an alternating pattern). The extensions 196 and the recesses 198 enable the outer ring 188 to engage protrusions 200 of the push/pull ring 194 of the seal assembly 162 and to thereby drive rotation of the push/pull ring 194 of the seal assembly 162. In turn, the push/pull ring 194 is coupled to the seal body 164 of the seal assembly 162 via a key-slot interface 202 (e.g., annular radially extending protrusions seated in annular grooves; wire or ball bearing groove(s); any suitable structure or interface that enables relative rotation and also push/pull). The key-slot interface 202 enables the push/pull ring 194 to rotate relative to the seal body 164 of the seal assembly 162, and also enables the push/pull ring 194 to transfer axial motion of the running tool 180 to the seal body 164 of the seal assembly 162 (e.g., push toward the wellbore; pull away from the wellbore).

Thus, rotation of the running tool 180 (e.g., the tool body 186 and the outer ring 188 of the running tool 180) in a first rotational direction causes the running tool 180 to thread onto the hanger 152, and also causes the seal assembly 162 to move relative to the hanger 152 toward the wellbore. Further, rotation of the running tool 180 in a second rotational direction causes the running tool 180 to thread off of the hanger 152, and also causes the seal assembly 162 to move relative to the hanger 152 away from the wellbore. The running tool 180 may be separated from the hanger 152 and the seal assembly 162 via the rotation of the running tool 180 in the second rotational direction to fully thread off of the hanger 152 (e.g., release from the respective threads on a radially inner surface of the hanger 152), and then via movement (e.g., pull) of the running tool 180 axially away from the wellbore (e.g., separate the protrusions 200 from extensions 196 and the recesses 198).

With reference to FIG. 12, in the locked position, one or more seal passages 210 formed in or through the seal assembly 162 may be fluidly coupled to the one or more passages 160 formed in the hanger 152. In particular, respective inlets 212 of the one or more seal passages 210 may be at the second axial location to align (e.g., axially and/or circumferentially; in some cases, an undercut or gap in the hanger 152 and/or the seal assembly 162 may fluidly couple passages 160, 210 that are not aligned circumferentially) with the respective outlets 174 of the one or more passages 160, and respective outlets of the one or more seal passages 210 may be at a third axial location to thereby enable a fluid (e.g., cement returns; drilling mud that is displaced during cementing operations) to flow from the respective inlets 172 of the one or more passages 160 to the respective outlets of the one or more seal passages 210.

Once the hanger 152 is in the locked position, the cementing operations may commence to cement the casing within the wellbore. In particular, the fluid may travel into the respective inlets 172, through the one or more passages 160, through the one or more seal passages 210, and out from the respective outlets of the one or more seal passages 210. In this way, the one or more passages 160 and the one or more seal passages 210 provide a bypass pathway for fluid flow between the first axial location within the wellhead housing 150 (e.g., below the first axial location relative to the wellbore; exposed to an annular space below the hanger 152) to the third axial location within the wellhead housing 150 (e.g., above the first axial location relative to the wellbore; exposed to another annular space above the hanger 152).

With reference to FIG. 13, from the locked position and after cementing operations, the seal assembly 162 is configured to move axially away from the wellbore and relative to the wellhead housing 150 (e.g., along the axial axis 44) to selectively seal the one or more passages 160 (and more generally to seal the annular space or a bore 216 below the hanger 152). Thus, the hanger 152 may be considered to be in a sealed position within the wellhead housing 150. For example, as described herein, the running tool 180 may rotate to drive (e.g., pull) the seal assembly 162 to a fourth axial location that is above the respective outlets 174 of the one or more passages 160 relative to the wellbore to thereby block the fluid flow across the hanger 152. In particular, the seal assembly 162 may contact and seal against the hanger 152 via the one or more inner seal elements 166, and the seal assembly 162 may contact and seal against the wellhead housing 150 via the one or more outer seal elements 168. Thus, the seal assembly 162 seals the annular space between a radially outer surface of the hanger 152 and a radially inner surface of the wellhead housing 150.

FIGS. 14-17 are cross-sectional side views of an embodiment of a portion of the wellhead 12. As shown, the portion of the wellhead 12 includes a wellhead housing 250 (e.g., a portion of a casing spool, such as a portion of the casing spool 26 of FIG. 1) and a hanger 252 (e.g., a casing hanger, such as the casing hanger 36 of FIG. 1). The hanger 252 is positioned in the wellhead housing 250 and is configured to suspend a casing that extends into a wellbore. The hanger 252 includes one or more passages 260 (e.g., axial passages).

A seal assembly 262 (e.g., annular seal assembly) is stacked axially relative to a portion of the hanger 252. As shown, the seal assembly 262 may include a seal body 264 (e.g., annular seal body; ring; a one-piece, solid body) that defines one or more seal passages 266 (e.g., openings; through holes) and one or more seal elements 268 that are distributed circumferentially about the seal body 264. For example, FIG. 14 includes an inset bottom view of a portion of the seal assembly 262, which shows the one or more seal passages 266 and the one or more seal elements 268 (e.g., sets of three seal passages 266 separated by elongated seal elements 268). Additionally, a push ring 270 (e.g., annular push ring) may circumferentially surround a portion of the seal body 264, and a retaining wire 272 (e.g., annular seal element; retaining ring) may be positioned between a radially outer surface of the seal body 264 and a radially inner surface of the push ring 270. The retaining wire 272 may be configured to enable the push ring 270 to rotate relative to the seal body 264, while also axially coupling the push ring 270 to the seal body 264 (e.g., via radial overlap). The retaining wire 272 may facilitate retrieval of the seal body 264 (e.g., for maintenance, such as replacement). One or more additional seal elements 275 (e.g., annular seal elements) may be positioned about the hanger 252.

In operation, a running tool 280 may lower the hanger 252 with the casing and the seal assembly 262 into the wellhead housing 250. With reference to FIG. 14, the running tool 280 may lower the hanger 252 until the hanger 252 reaches a landed position in which the hanger 252 is landed on the wellhead housing 250 (e.g., axially facing or radially overlapping surfaces contact one another at an interface 276 to block further movement of the hanger 252 relative to the wellhead housing 250 toward the wellbore). In the landed position, respective inlets 278 of the one or more passages 260 are positioned at a first axial location within the wellhead housing 250 (e.g., along the axial axis 44), and respective outlets 282 of the one or more passages 260 are positioned at a second axial location within the wellhead housing 250 (e.g., along the axial axis 44).

Additionally, during running operations toward the landed position and in the landed position, a lock ring 284 (e.g., c-ring) is positioned in a recess (e.g., annular recess), which may be defined by an upper end of the hanger 252 and a portion of the push ring 270. Further, during the running operations toward the landed position and in the landed position, the seal assembly 262 is axially stacked relative to the hanger 252 (e.g., axially stacked above the hanger 252 relative to the wellbore). As discussed herein, this position enables rotation of the seal assembly 262 to selectively uncover and cover the one or more passages 260 in the hanger 252 (e.g., enable fluid flow and block fluid flow across the hanger 252).

Thus, as shown in FIG. 14, the seal assembly 262 may be positioned (e.g., rotated) to align the one or more seal passages 266 of the seal assembly 262 with the one or more passages 260 of the hanger 252 (e.g., along the circumferential axis 48). In this way, the one or more seal passages 266 and the one or more passages 260 may enable a fluid (e.g., cement returns; drilling mud that is displaced during cementing operations) to flow from the respective inlets 278 of the one or more passages 260 to respective outlets of the one or more seal passages 266. In particular, once the hanger 252 is in the landed position, the cementing operations may commence to cement the casing within the wellbore. In particular, the fluid may travel into the respective inlets 278, through the one or more passages 260, through the one or more seal passages 266, and out from the respective outlets of the one or more seal passages 266. In this way, the one or more passages 260 and the one or more seal passages 266 provide a bypass pathway for fluid flow between the first axial location within the wellhead housing 250 (e.g., below the first axial location relative to the wellbore; exposed to an annular space below the hanger 252) to a third axial location within the wellhead housing 250 (e.g., above the first axial location relative to the wellbore; exposed to another annular space above the hanger 252).

With reference to FIG. 15, from the landed position, the running tool 280 may drive (e.g., rotate) the seal assembly 262 and the push ring 270 relative to the hanger 252 and relative to the wellhead housing 250. It should be appreciated that the running tool 280 may couple to the hanger 252 and the seal assembly 262 via any of a variety of types of connections that enable operations described herein. In FIGS. 14-17, the running tool 280 includes a tool body 286 (e.g., annular body) and an outer ring 288 (e.g., annular ring). The tool body 286 and the outer ring 288 are coupled (e.g., fixed) together via one or more fasteners 290 (e.g., pins). The tool body 286 is coupled (e.g., threadably) to the hanger 252 via a threaded interface 292 (e.g., respective threads on a radially outer surface of the tool body 286 threadably couple to respective threads on a radially inner surface of the hanger 252).

The outer ring 288 is coupled (e.g., non-rotatably; rotationally locked; axially free) to the push ring 270. In particular, with reference to FIGS. 14-16, the outer ring 288 includes extensions 296 (e.g., axial extensions; teeth) distributed circumferentially about the outer ring 288 (e.g., four extensions 296 spaced apart about the outer ring 288). The extensions 296 fit (e.g., slide axially) into slots 298 (e.g., axial slots) formed in and distributed circumferentially about a radially inner surface of the push ring 270 (e.g., four slots 298 spaced apart about the push ring 270). The extension 296 and the slots 298 overlap along the radial axis 46 to enable rotation of the outer ring 288 of the running tool 180 to drive rotation of the push ring 270.

The push ring 270 is coupled (e.g., threadably) to the hanger 252 via a threaded interface 300 (e.g., respective threads on a radially outer surface of the push ring 270 threadably couple to respective threads on a radially inner surface of the hanger 252). Additionally, the outer ring 288 is coupled to the seal body 264 of the seal assembly 262 via pins 302 (e.g., axial pins; distributed circumferentially about the seal body 264 of the seal assembly 262).

In operation, from the landed position shown in FIG. 14, rotation of the running tool 280 (e.g., the tool body 286 and the outer ring 288 of the running tool 280) in a rotational direction causes the running tool 280 to thread off of the hanger 252 and to move away from the wellbore. Additionally, the rotation of the running tool 280 also causes the seal assembly 262 to rotate in the rotational direction, via the pins 302, to cause the one or more seal elements 268 to cover the one or more passages 260 to block the flow of fluid across the hanger 252.

Figure 17:
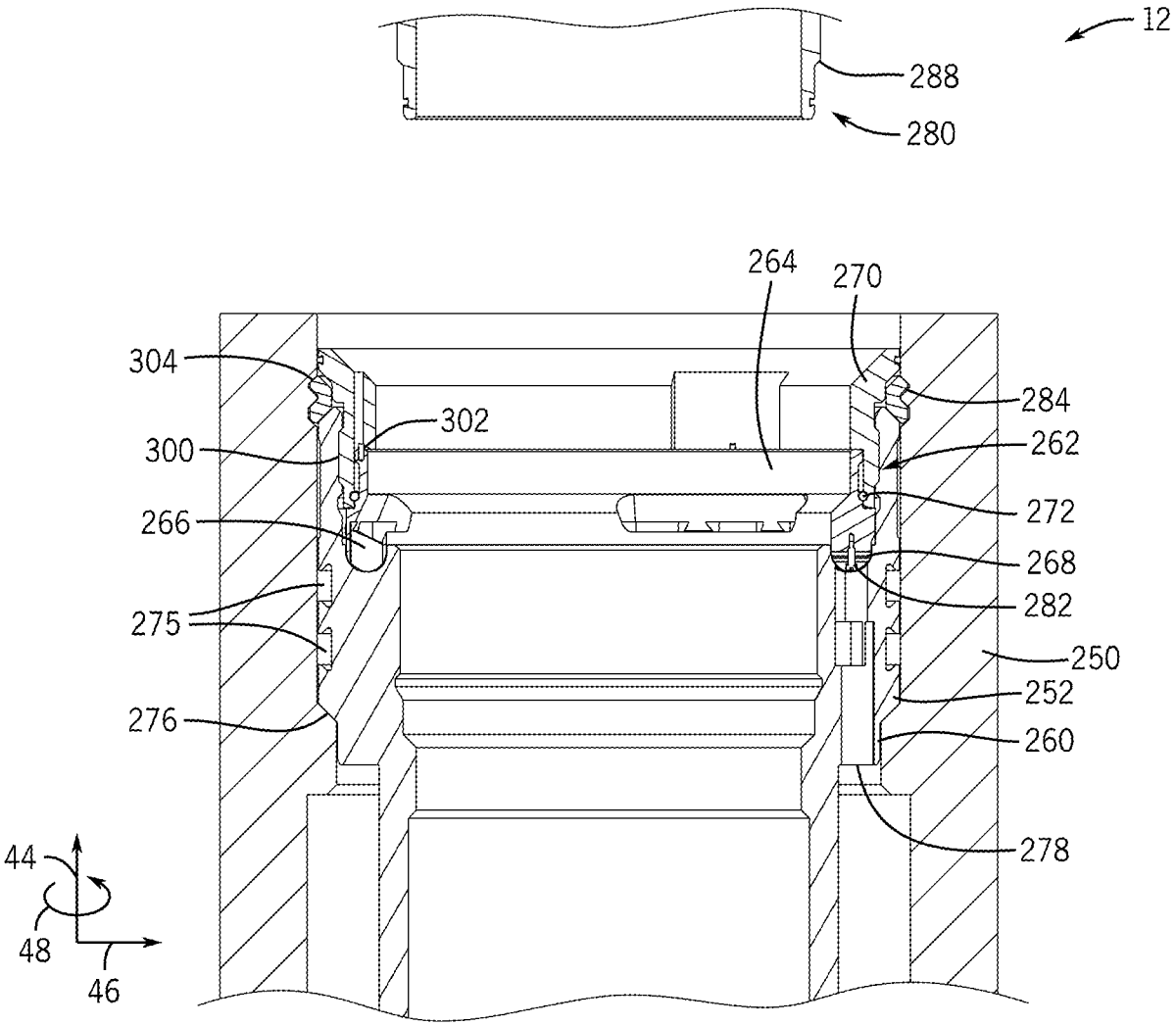
FIG. 17 is a cross-sectional side view of an embodiment of the portion of the wellhead of FIG. 14, wherein the hanger is in the sealed position and a running tool is separated from the hanger.

Further, the rotation of the running tool 280 also causes the push ring 270 to rotate in the rotational direction, via contact between the extensions 296 and the slots 298. The threaded interface 292 and the threaded interface 300 may be in opposite directions (e.g., right hand and left hand), and thus, the rotation of the running tool 280 to thread off of the hanger 252 (e.g., move axially away from the wellbore) may also drive the push ring 270 to thread onto the hanger 252 (e.g., move axially toward the wellbore). Accordingly, the push ring 270 may move relative to the seal assembly 262 and contact a shoulder of the seal body 264 of the seal assembly 262 to hold the seal assembly 262 within the wellhead housing 250. Additionally, the push ring 270 may move relative to the hanger 252 and drive the lock ring 284 radially outwardly into a groove 304 formed in the wellhead housing 250. Thus, the hanger 252 may be considered to be in a locked position within the wellhead housing 250. As the tool body 286 and the outer ring 288 move axially away from the wellbore, the outer ring 288 may separate or disengage from the pins 302 to that the seal assembly 262 rotates an appropriate or suitable amount to position the one or more seal elements 268 to cover the one or more passages 260 to block the flow of fluid across the hanger 252. As shown in FIG. 17, the running tool 280 may be separated from the hanger 252 and the seal assembly 262 via the rotation of the running tool 280 in the rotational direction to fully thread off of the hanger 252 (e.g., release from the respective threads on a radially inner surface of the hanger 252) and to withdraw the extensions 296 of the outer ring 288 from the slots 298 of the push ring 270.

FIGS. 18-23 are cross-sectional side views of an embodiment of a portion of the wellhead 12. As shown, the portion of the wellhead 12 includes a wellhead housing 350 (e.g., a portion of a casing spool, such as a portion of the casing spool 26 of FIG. 1) and a hanger 352 (e.g., a casing hanger, such as the casing hanger 36 of FIG. 1). The hanger 352 is positioned in the wellhead housing 350 and is configured to suspend a casing 354 that extends into a wellbore. The hanger 352 includes one or more passages 360 (e.g., axial passages).

A seal assembly 362 (e.g., annular seal assembly) is stacked axially relative to a portion of the hanger 352. As shown, the seal assembly 362 may include a seal body 364 (e.g., annular seal body; ring; a one-piece, solid body) that defines one or more seal passages 366 (e.g., openings; through holes) that are distributed circumferentially about the seal body 364. It should be appreciated that one or more seal elements may also be distributed about the seal body 364 (e.g., between adjacent seal passages 366). Additionally, a push ring 370 (e.g., annular push ring) may circumferentially surround a portion of the seal body 364, and a lock ring 372 (e.g., c-ring) may be supported on the seal body 364. One or more additional seal elements 375 (e.g., annular seal elements) may be positioned about the hanger 352.

Figure 18:
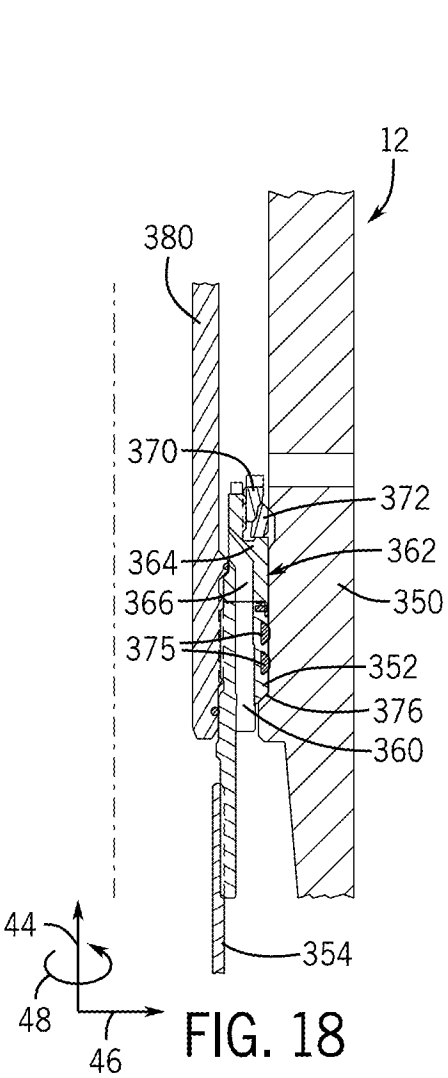
FIG. 18 is a cross-sectional side view of an embodiment of a wellhead that may be utilized in the mineral extraction system of FIG. 1, wherein a hanger includes one or more passages and is in a landed position.

With reference to FIG. 18, a running tool 380 may lower the hanger 352 with the casing 354 and the seal assembly 362 into the wellhead housing 350. In particular, the running tool 380 may lower the hanger 352 until the hanger 352 reaches a landed position in which the hanger 352 is landed on the wellhead housing 350 (e.g., axially facing or radially overlapping surfaces contact one another at an interface 376 to block further movement of the hanger 352 relative to the wellhead housing 350 toward the wellbore). In the landed position, respective inlets of the one or more passages 360 are positioned at a first axial location within the wellhead housing 350 (e.g., along the axial axis 44), and respective outlets of the one or more passages 360 are positioned at a second axial location within the wellhead housing 350 (e.g., along the axial axis 44).

Additionally, during the running operations toward the landed position and in the landed position, the seal assembly 362 is axially stacked relative to the hanger 352 (e.g., axially stacked above the hanger 352 relative to the wellbore). As discussed herein, this position enables rotation of the seal assembly 362 to selectively uncover and cover the one or more passages 360 in the hanger 352 (e.g., enable fluid flow and block fluid flow across the hanger 352).

Figure 20:
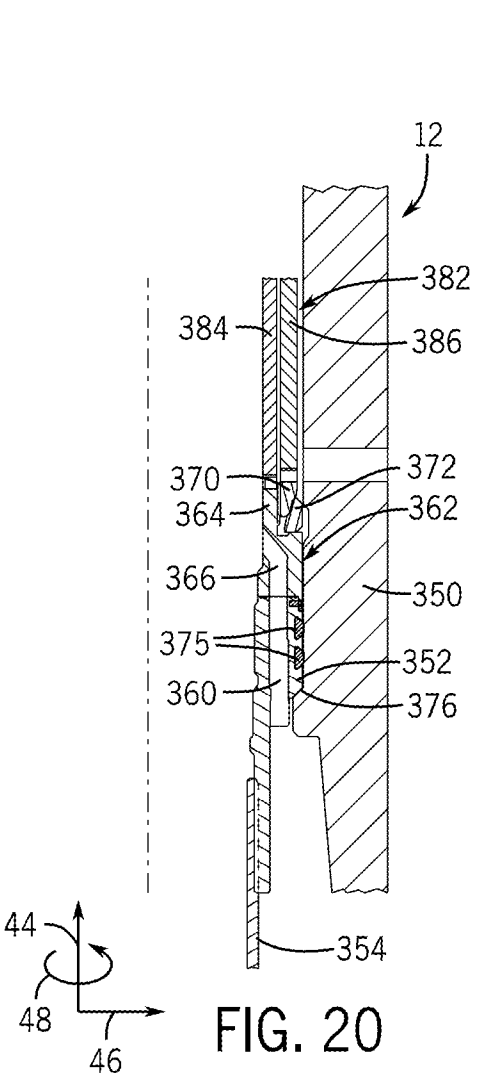
FIG. 20 is a cross-sectional side view of an embodiment of the portion of the wellhead of FIG. 18, wherein a setting tool is coupled to a seal assembly.
Figure 19:
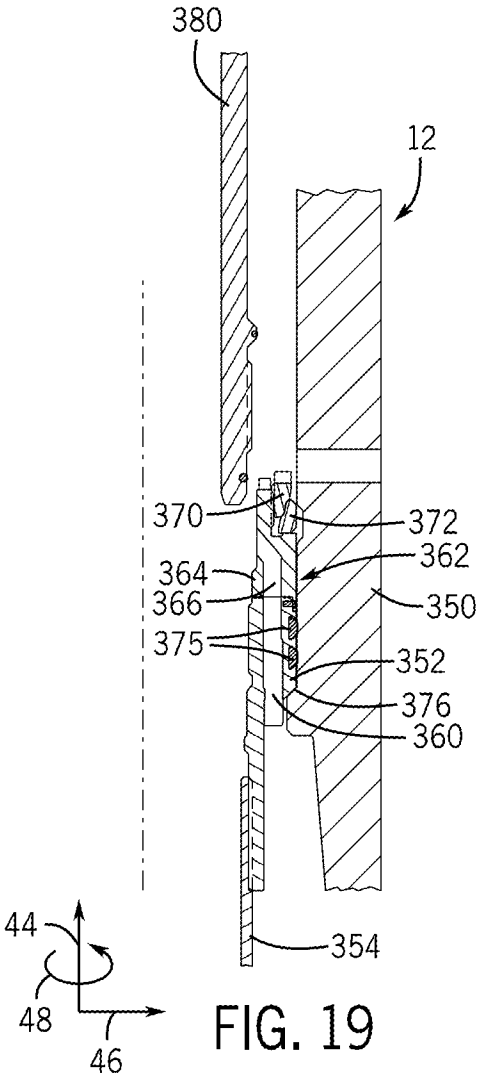
FIG. 19 is a cross-sectional side view of an embodiment of the portion of the wellhead of FIG. 18, wherein a running tool is separated from the hanger.

Thus, as shown in FIGS. 18-20, the seal assembly 362 may be positioned (e.g., rotated) to align the one or more seal passages 366 of the seal assembly 362 with the one or more passages 360 of the hanger 352 (e.g., along the circumferential axis 48). In this way, the one or more seal passages 366 and the one or more passages 360 may enable a fluid (e.g., cement returns; drilling mud that is displaced during cementing operations) to flow from the respective inlets of the one or more passages 360 to respective outlets of the one or more seal passages 366. In particular, once the hanger 352 is in the landed position, cementing operations may commence to cement the casing within the wellbore, and the one or more passages 360 and the one or more seal passages 366 provide a bypass pathway for fluid flow between the first axial location within the wellhead housing 350 (e.g., below the first axial location relative to the wellbore; exposed to an annular space below the hanger 352) to a third axial location within the wellhead housing 350 (e.g., above the first axial location relative to the wellbore; exposed to another annular space above the hanger 352).

With reference to FIGS. 19 and 20, from the landed position, the running tool 380 may be withdrawn (e.g., separated; retrieved). Then, a setting tool 382 may be coupled to the seal assembly 262 and/or to the push ring 370. For example, as shown in FIG. 20, an inner ring 384 (e.g., seal setting ring) of the setting tool 382 may couple (e.g., non-rotatably; rotationally locked; axially free; via extensions and slots) to the seal assembly 362, and an outer ring 386 (e.g., lock setting ring) of the setting tool 382 may be positioned proximate to the push ring 370 (e.g., above the push ring 370 relative to the wellbore).

Figure 23:
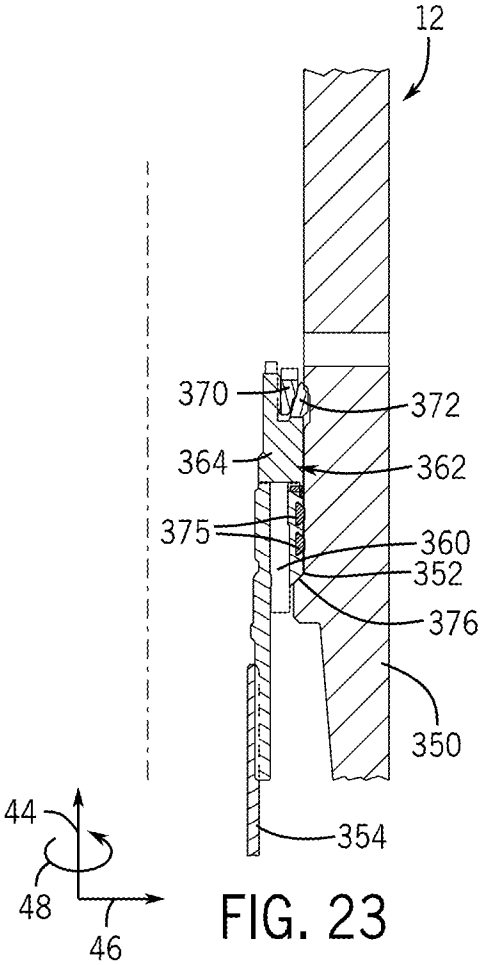
FIG. 23 is a cross-sectional side view of an embodiment of the portion of the wellhead of FIG. 18, wherein the setting tool is separated from the seal assembly.
Figure 22:
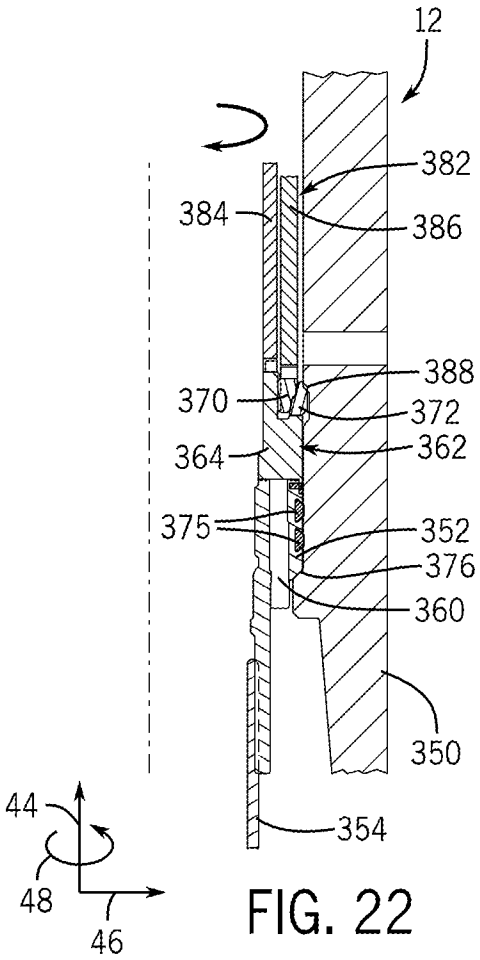
FIG. 22 is a cross-sectional side view of an embodiment of the portion of the wellhead of FIG. 18, wherein the hanger is in a locked position.
Figure 21:
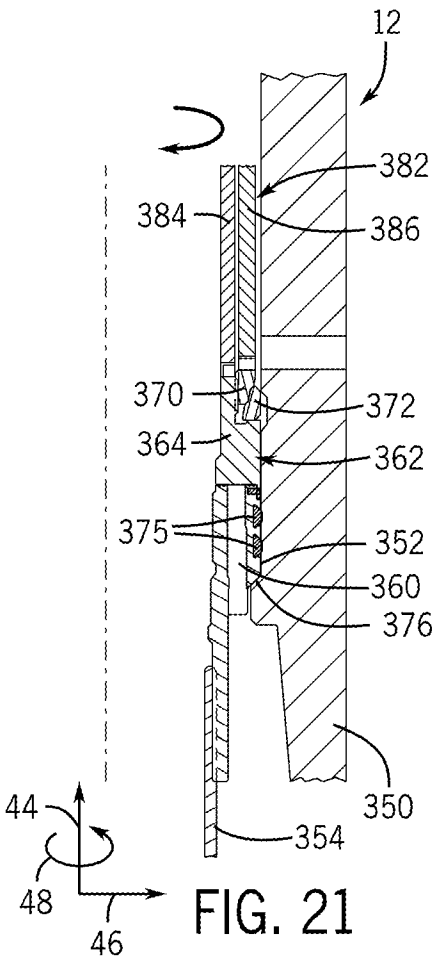
FIG. 21 is a cross-sectional side view of an embodiment of the portion of the wellhead of FIG. 18, wherein rotation of the setting tool drives rotation of the seal assembly and the hanger is in a sealed position.

With reference to FIGS. 20 and 21, the setting tool 382 may drive (e.g., rotate) the seal assembly 362 relative to the hanger 352 and relative to the wellhead housing 350. In particular, rotation of at least the inner ring 384 of the setting tool 382 may drive rotation of the seal assembly 362 to cause solid portions of the seal body 364 (e.g., the one or more seal elements) to cover the one or more passages 360 to block the flow of fluid across the hanger 352. With reference to FIG. 22, the setting tool 382 may then drive the push ring 370 axially toward the wellbore (e.g., via pushing the pushing ring 370 axially toward the wellbore; if the push ring 370 is threaded onto the seal body 364, via rotating the push ring 370 to move the push ring 370 axially toward the wellbore), which in turn drives the lock ring 372 radially outwardly to engage a groove 388 (e.g., annular groove) formed in the wellhead housing 350. In particular, axial movement of the outer ring 386 of the setting tool 382 may drive the push ring 370 axially toward the wellbore to engage the lock ring 372 with the groove 388. Thus, the hanger 352 may be considered to be in a locked position within the wellhead housing 350. With reference to FIG. 23, the setting tool 382 may then be withdrawn (e.g., separated; retrieved).

Figure 25:
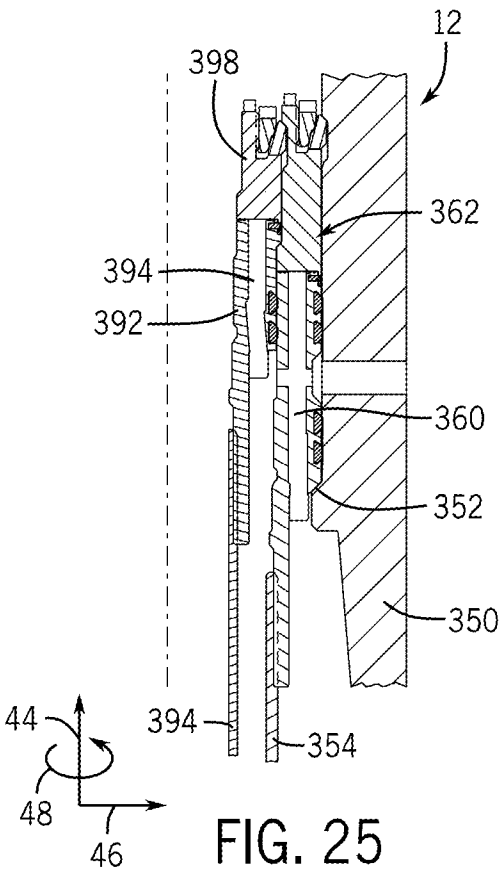
FIG. 25 is a cross-sectional side view of an embodiment of the portion of the wellhead of FIG. 18, wherein an additional hanger is supported on the hanger.
Figure 24:
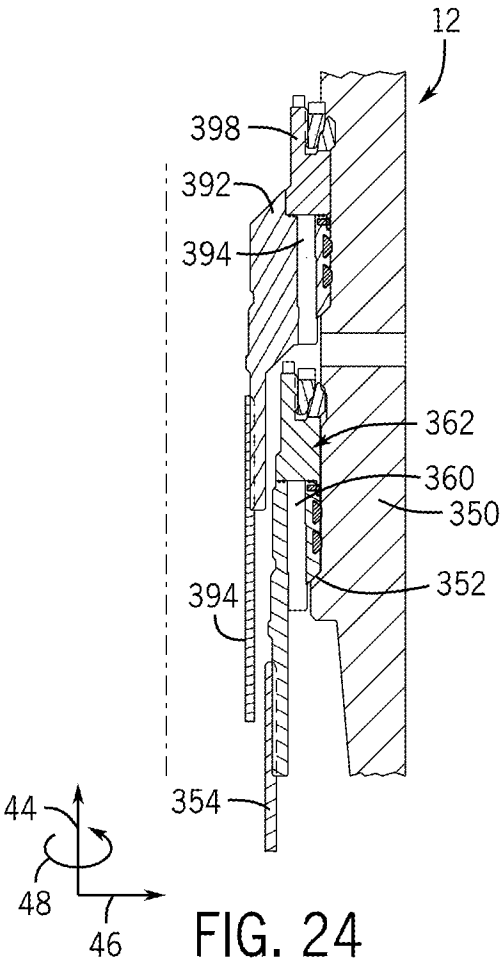
FIG. 24 is a cross-sectional side view of an embodiment of the portion of the wellhead of FIG. 18, wherein multiple hangers are supported on a wellhead housing.

FIGS. 24 and 25 are cross-sectional side views of an embodiment of a portion of the wellhead 12 with multiple hangers, including the hanger 352 that supports the casing 354 and an additional hanger 392 that supports an additional casing. As shown, the hanger 352 includes the one or more passages 360 that are selectively covered and uncovered via rotation of the seal assembly 362. Additionally, the additional hanger 392 includes one or more respective passages 396 that are selectively covered and uncovered via rotation of an additional seal assembly 398. In FIG. 24, the additional hanger 392 is supported on a separate shoulder of the wellhead housing 350. In FIG. 25, the additional hanger 392 is supported on the hanger 352.

Figure 27:
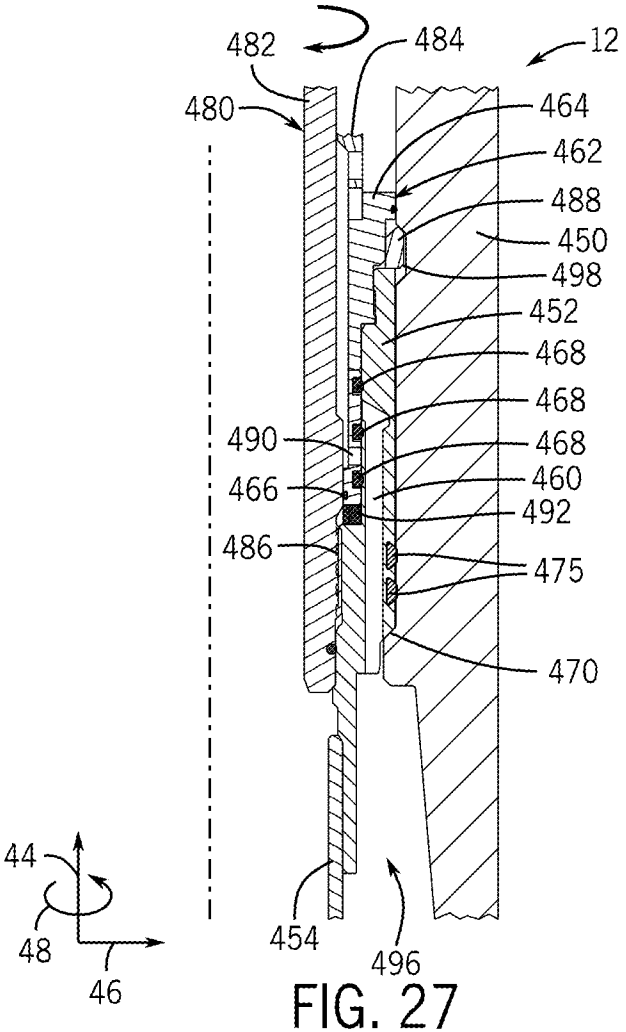
FIG. 27 is a cross-sectional side view of an embodiment of the portion of the wellhead of FIG. 26, wherein the hanger is in a sealed and locked position.
Figure 26:
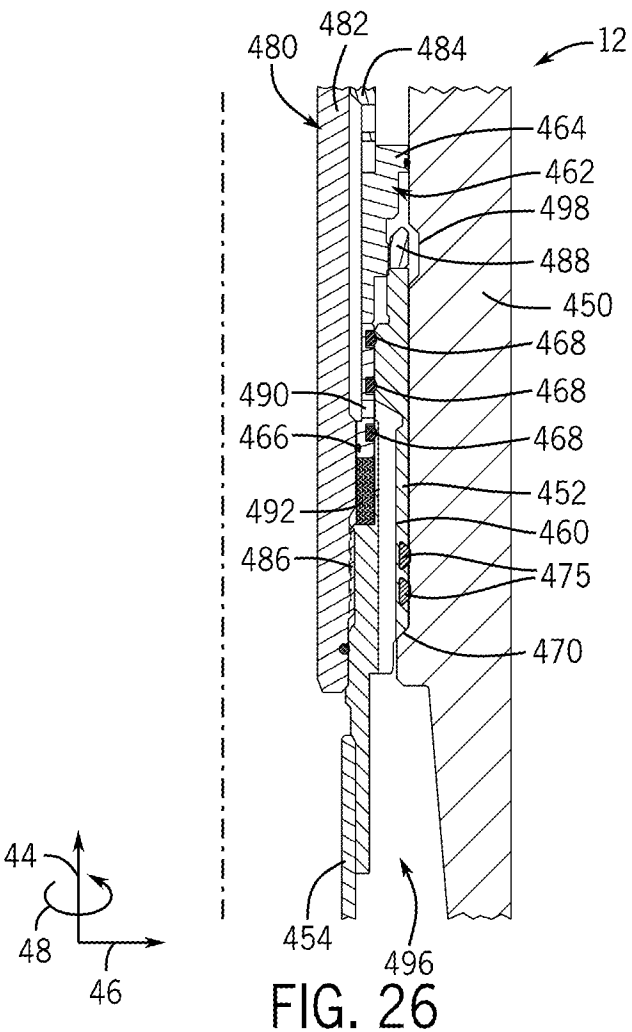
FIG. 26 is a cross-sectional side view of an embodiment of a wellhead that may be utilized in the mineral extraction system of FIG. 1, wherein a hanger includes one or more passages and is in a landed position.

FIGS. 26 and 27 are cross-sectional side views of an embodiment of a portion of the wellhead 12. As shown, the portion of the wellhead 12 includes a wellhead housing 450 (e.g., a portion of a casing spool, such as a portion of the casing spool 26 of FIG. 1) and a hanger 452 (e.g., a casing hanger, such as the casing hanger 36 of FIG. 1). The hanger 452 is positioned in the wellhead housing 450 and is configured to suspend a casing 454 that extends into a wellbore. The hanger 452 includes one or more passages 460 (e.g., axial passages).

A seal assembly 462 (e.g., annular seal assembly) is supported on a portion of the hanger 452. As shown, the seal assembly 462 may include a seal body 464 (e.g., annular seal body; ring; a one-piece, solid body) that defines one or more inner seal grooves (e.g., annular seal grooves) that support one or more inner seal elements 466 (e.g., annular seal elements). Additionally, the seal assembly 462 may include the seal body 464 that defines one or more outer seal grooves (e.g., annular seal grooves) that support one or more outer seal elements 468 (e.g., annular seal elements). One or more additional seal elements 475 (e.g., annular seal elements) may be positioned about the hanger 452.

In operation, a running tool 480 may lower the hanger 452 with the casing 454 and the seal assembly 462 into the wellhead housing 450. With reference to FIG. 26, the running tool 480 may lower the hanger 452 until the hanger 452 reaches a landed position in which the hanger 452 is landed on the wellhead housing 450 (e.g., axially facing or radially overlapping surfaces contact one another at an interface 470 to block further movement of the hanger 452 relative to the wellhead housing 450 toward the wellbore). In the landed position, respective inlets of the one or more passages 460 are positioned at a first axial location within the wellhead housing 450 (e.g., along the axial axis 44), and respective outlets of the one or more passages 460 are positioned at a second axial location within the wellhead housing 450 (e.g., along the axial axis 44). Additionally, in the landed position, the seal assembly 462 may contact and seal against the running tool 480 via the one or more inner seal elements 466, and/or the seal assembly 462 may contact and seal against the hanger 452 via the one or more outer seal elements 468.

Further, in the landed position, one or more seal passages 490 formed in the seal assembly 462 may be at or proximate to the second axial location within the wellhead housing 450 to align with and to fluidly couple to the respective outlets of the one or more passages 460 formed in the hanger 452. In particular, the one or more seal passages 490 may be radially extending openings across the seal body 464 of the seal assembly 462 to enable fluid flow radially across the seal body 464 of the seal assembly 462. Thus, cementing operations may commence to cement the casing 454 within the wellbore. In this way, the one or more passages 460 and the one or more seal passages 490 provide a bypass pathway for fluid flow between the first axial location within the wellhead housing 450 (e.g., below the first axial location relative to the wellbore; exposed to an annular space below the hanger 452) to a third axial location within the wellhead housing 450 (e.g., above the first axial location relative to the wellbore; exposed to another annular space above the hanger 452).

The running tool 480 may include an inner ring 482 (e.g., annular ring) and an outer ring 484 (e.g., annular ring). The inner ring 482 may be coupled to the hanger 452 via a threaded interface, and the outer ring 484 may be slidingly coupled to the inner ring 482 (or the outer ring 484 and the inner ring 482 may be rotationally locked together and axially free, such that rotation is used to move the outer ring 484 relative to the inner ring 482). With reference of FIG. 27, from the landed position, the outer ring 484 may move axially to drive (e.g., push; via rotation, if the seal assembly 462 is threaded onto the hanger 452) the seal assembly 462 axially toward the wellbore and relative to the hanger 452. As shown, the seal assembly 462 may contact and drive a lock ring 488 (e.g., c-ring) axially toward the wellbore, which may cause the lock ring 488 to move radially outwardly to engage a groove 498 (e.g., annular groove) formed in the wellhead housing 450 to thereby lock the hanger 452 within the wellhead housing 450. Thus, the hanger 452 may be considered to be in a locked position within the wellhead housing 450.

Further, as the seal assembly 462 moves axially toward the wellbore, the seal assembly 462 may compress a compressible material 492 (e.g., syntactic foam; compressible or breakable glass beads) that is positioned in an axial space between the seal assembly 462 and the hanger 452. The compressible material 492 may support the seal assembly 462 and/or block debris or fluid flow across the compressible material 492.

As shown in FIG. 27, in the locked position (e.g., after cementing operations), the seal assembly 462 is positioned to selectively seal the one or more passages 460 (and more generally to seal the annular space or a bore 496 below the hanger 452). In particular, the seal assembly 462 may contact and seal against the hanger 452 via the one or more outer seal elements 468. Thus, the hanger 452 may be considered to be in a sealed position within the wellhead housing 450. From the locked position and the sealed position, the running tool 480 be withdrawn, such as via rotation of at least the inner ring 482 of the running tool 480 to unthread the running tool 480 from the hanger 452 (e.g., at the threaded interface 486).

Figure 30:
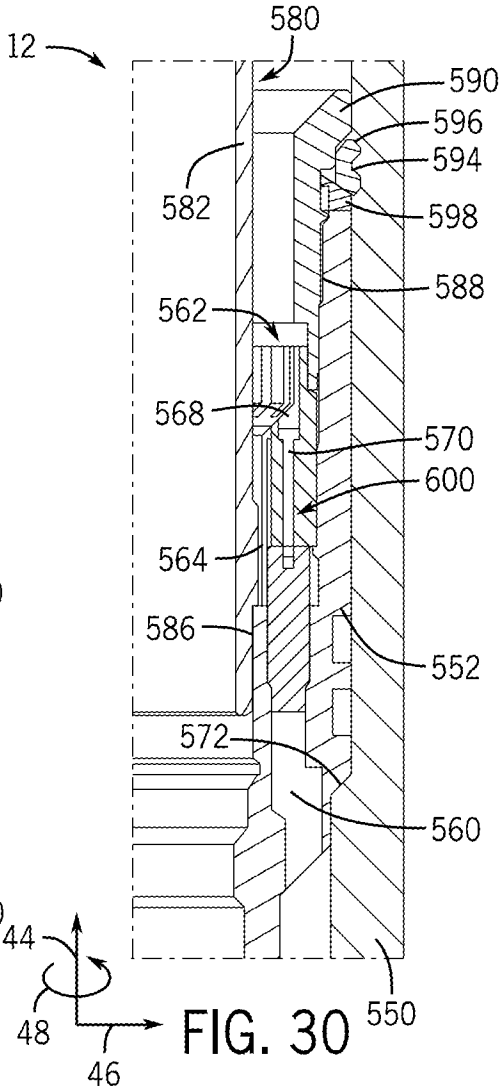
FIG. 30 is a cross-sectional side view of an embodiment of the portion of the wellhead of FIG. 28, wherein the hanger is in a sealed and locked position.
Figure 29:
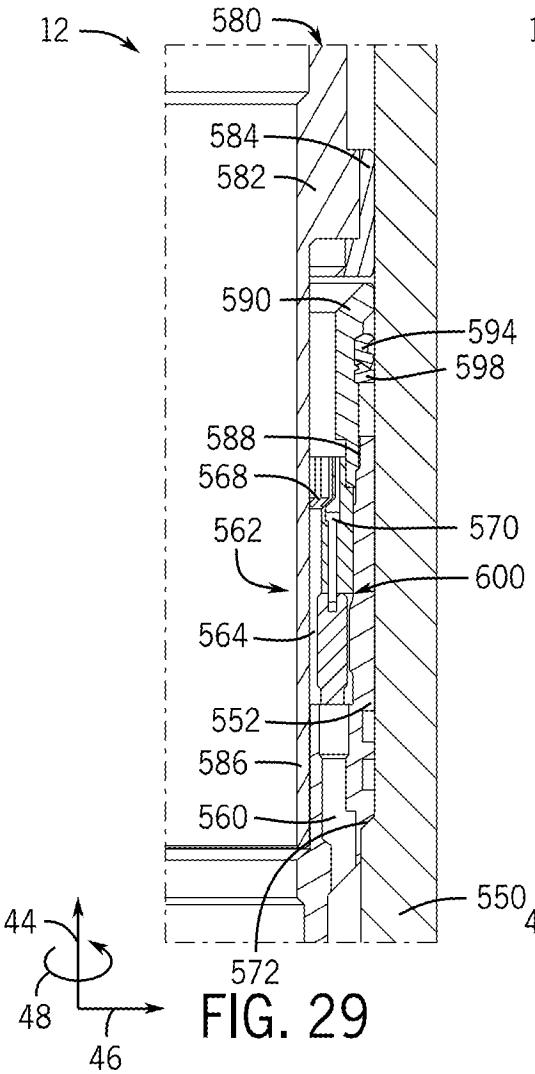
FIG. 29 is a cross-sectional side view of an embodiment of the portion of the wellhead of FIG. 28, wherein one or more plungers of a seal assembly are aligned with the one or more passages.
Figure 28:
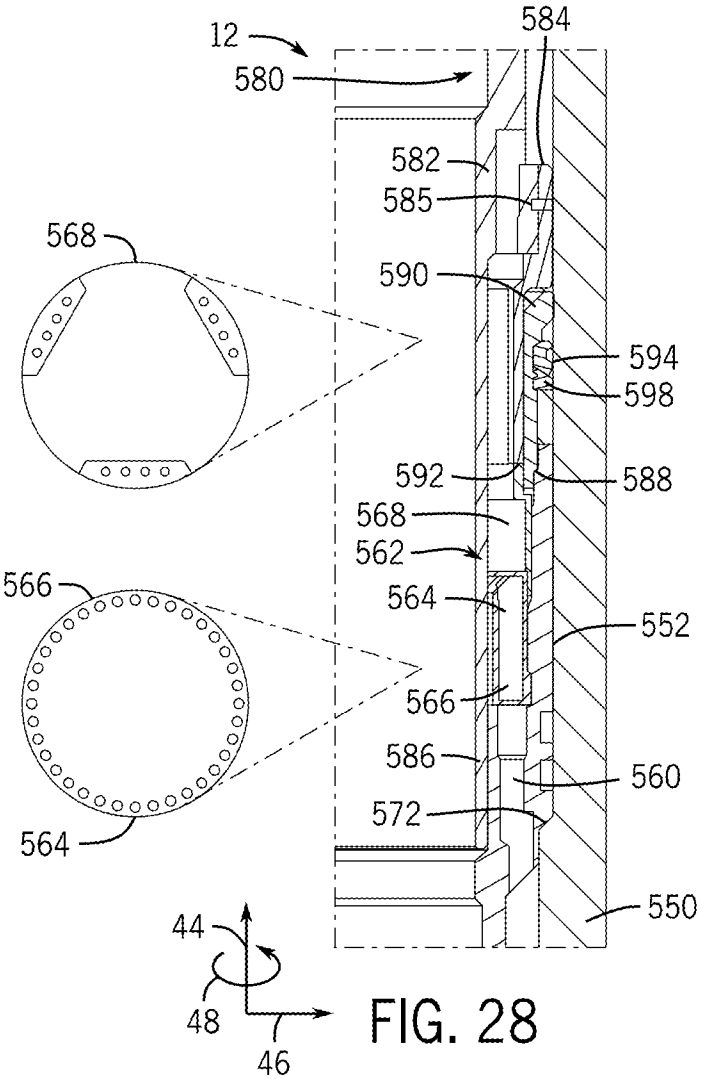
FIG. 28 is a cross-sectional side view of an embodiment of a wellhead that may be utilized in the mineral extraction system of FIG. 1, wherein a hanger includes one or more passages and is in a landed position.

FIGS. 28-30 are cross-sectional side views of an embodiment of a portion of the wellhead 12. As shown, the portion of the wellhead 12 includes a wellhead housing 550 (e.g., a portion of a casing spool, such as a portion of the casing spool 26 of FIG. 1) and a hanger 552 (e.g., a casing hanger, such as the casing hanger 36 of FIG. 1). The hanger 552 is positioned in the wellhead housing 550 and is configured to suspend a casing that extends into a wellbore. The hanger 552 includes one or more passages 560 (e.g., axial passages).

A seal assembly 562 (e.g., annular seal assembly) is positioned proximate to the hanger 552. As shown, the seal assembly 562 may include a first seal body 564 (e.g., annular seal body; ring; a one-piece, solid body) that defines one or more seal passages 566 distributed circumferentially about the first seal body 564. Additionally, the seal assembly 562 may include a second seal body 568 (e.g., annular seal body; ring; a one-piece, solid body) that supports one or more plunger pins 570 distributed circumferentially about the second seal body 568. FIG. 28 includes insets that illustrate a top view of the first seal body 564 and the second seal body 568.

In operation, a running tool 580 may lower the hanger 552 with the casing and the seal assembly 562 into the wellhead housing 550. With reference to FIG. 28, the running tool 580 may lower the hanger 552 until the hanger 552 reaches a landed position in which the hanger 552 is landed on the wellhead housing 550 (e.g., axially facing or radially overlapping surfaces contact one another at an interface 572 to block further movement of the hanger 552 relative to the wellhead housing 550 toward the wellbore). With reference to FIG. 28, respective inlets of the one or more passages 560 are positioned at a first axial location within the wellhead housing 550 (e.g., along the axial axis 44), and respective outlets of the one or more passages 560 are positioned at a second axial location within the wellhead housing 550 (e.g., along the axial axis 44). Further, in the landed position, the one or more seal passages 566 formed in the first seal body 564 of the seal assembly 562 may be circumferentially aligned with and fluidly coupled to the respective outlets of the one or more passages 560 formed in the hanger 552. Further, in the landed position, the second seal body 568 may not block or cover the one or more passages 560 and the one or more seal passages 566.

Thus, once the hanger 552 is in the landed position, cementing operations may commence to cement the casing within the wellbore. In this way, the one or more passages 560 and the one or more seal passages 566 provide a bypass pathway for fluid flow between the first axial location within the wellhead housing 550 (e.g., below the first axial location relative to the wellbore; exposed to an annular space below the hanger 552) to a third axial location within the wellhead housing 550 (e.g., above the first axial location relative to the wellbore; exposed to another annular space above the hanger 552).

The running tool 580 may include an inner ring 582 (e.g., annular ring) and an outer ring 584 (e.g., annular ring). The inner ring 582 may be coupled (e.g., fixed) to the outer ring 584 via one or more fasteners 585 (e.g., pins). The inner ring 582 may be coupled to the hanger 552 via a threaded interface 586, and the outer ring 584 may be coupled (e.g., non-rotatably; rotationally locked; axially free) to a push ring 590 (e.g., annular push ring), such as via extensions and slots (e.g., key-slot interface). The outer ring 584 may also be coupled (e.g., non-rotatably; rotationally locked; axially free) to the second seal body 568 via one or more pins 592.

In operation, from the landed position and after cementing operations, rotation of the running tool 580 in a rotational direction causes the push ring 590 to rotate in the rotational direction, via contact between the outer ring 584 and the push ring 590. A threaded interface 588 between the push ring 590 and the hanger 552 and the threaded interface 586 may be in opposite directions (e.g., right hand and left hand), and thus, the rotation of the running tool 580 to thread off of the hanger 552 (e.g., move axially away from the wellbore) may also drive the push ring 590 to thread onto the hanger 552 (e.g., move axially toward the wellbore).

As the inner ring 582 and the outer ring 584 move axially away from the wellbore, the outer ring 584 may separate or disengage from the pins 592 so that the seal assembly 562 rotates an appropriate or suitable amount (e.g., a limited amount, such as 60 degrees) to move one or more plungers 600 into alignment with the one or more passages 560 (e.g., along the circumferential axis 48). Further, the push ring 590 may move relative to the seal assembly 562 and contact a shoulder of the second seal body 568 of the seal assembly 562 to drive the seal assembly 562 within the wellhead housing 550. Thus, further rotation of the running tool 580 and the push ring 590 may drive the one or more plungers 600 into the one or more passages 560 of the hanger 552.

Additionally, the push ring 590 may move relative to the hanger 552 and drive a lock ring 594 radially outwardly into a groove 596 (e.g., annular groove) formed in the wellhead housing 550. As shown, a support ring 598 may be provided to facilitate driving the lock ring 594 in this manner. Thus, the hanger 552 may be considered to be in a locked position within the wellhead housing 550. As shown in FIG. 30, the running tool 580 may be separated from the hanger 552 and the seal assembly 562 via the rotation of the running tool 480 in the rotational direction to fully thread off of the hanger 552 (e.g., release from the respective threads on a radially inner surface of the hanger 552) and to withdraw the outer ring 584 from the push ring 590.

FIGS. 31-34 are cross-sectional side views of an embodiment of a portion of the wellhead 12. As shown, the portion of the wellhead 12 includes a wellhead housing 650 (e.g., a portion of a casing spool, such as a portion of the casing spool 26 of FIG. 1) and a hanger 652 (e.g., a casing hanger, such as the casing hanger 36 of FIG. 1). The hanger 652 is positioned in the wellhead housing 650 and is configured to suspend a casing 654 that extends into a wellbore. The hanger 652 includes one or more passages 660 (e.g., axial passages).

Figure 31:
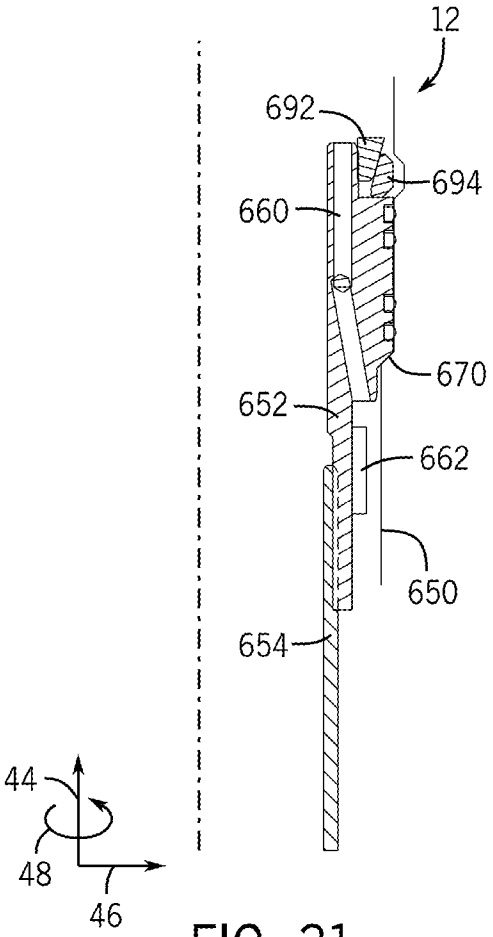
FIG. 31 is a cross-sectional side view of an embodiment of a wellhead that may be utilized in the mineral extraction system of FIG. 1, wherein a hanger includes one or more passages and is in a landed position.

A seal assembly 662 (e.g., annular seal assembly) is positioned axially below the hanger 652. As shown, the seal assembly 662 may include an inflatable bladder (e.g., annular inflatable bladder) that is fluidly coupled to a fluid source via a conduit 664 formed through the hanger 652. The one or more passages 660 and the conduit 664 may be offset along the circumferential axis 48. In operation, a running tool may lower the hanger 652 with the casing and the seal assembly 662 into the wellhead housing 650. With reference to FIG. 31, the running tool may lower the hanger 652 until the hanger 652 reaches a landed position in which the hanger 652 is landed on the wellhead housing 650 (e.g., axially facing or radially overlapping surfaces contact one another at an interface 670 to block further movement of the hanger 652 relative to the wellhead housing 650 toward the wellbore). Further, the seal assembly 662 may be in a compressed configuration (e.g., deflated).

In the landed position and with the seal assembly 662 in the compressed configuration, the seal assembly 662 enables fluid flow into and through the one or more passages 660. Thus, cementing operations may commence to cement the casing within the wellbore. In this way, the one or more passages 660 provide a bypass pathway for fluid flow between a first axial location within the wellhead housing 650 (e.g., below the hanger 652; exposed to an annular space below the hanger 652) to a second axial location within the wellhead housing 650 (e.g., above the first axial location relative to the wellbore; exposed to another annular space above the hanger 652).

Figure 33:
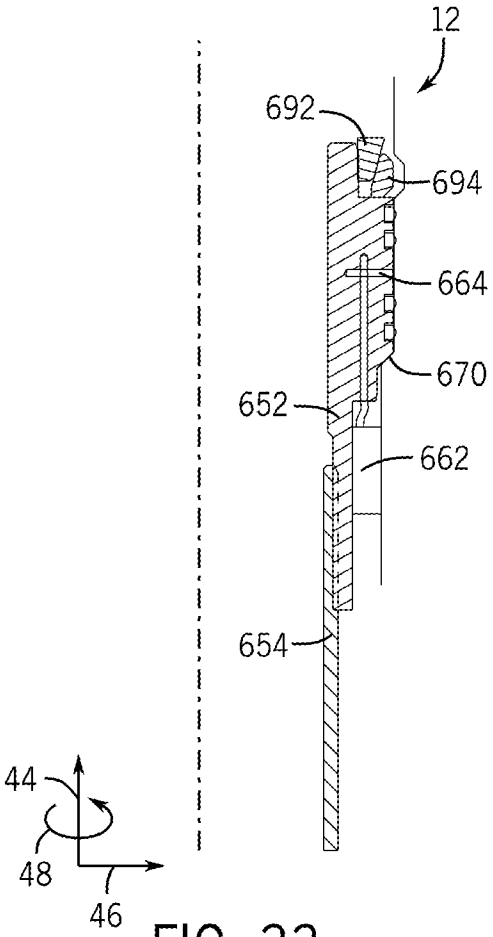
FIG. 33 is a cross-sectional side view of an embodiment of the portion of the wellhead of FIG. 31, wherein the hanger is in a sealed position.
Figure 32:
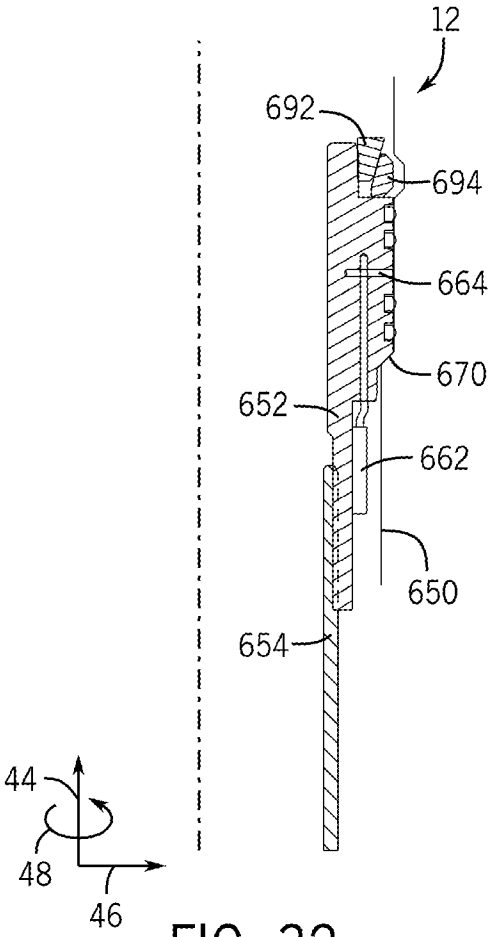
FIG. 32 is a cross-sectional side view of an embodiment of the portion of the wellhead of FIG. 31, wherein a seal assembly includes an inflatable bladder.
Figure 34:
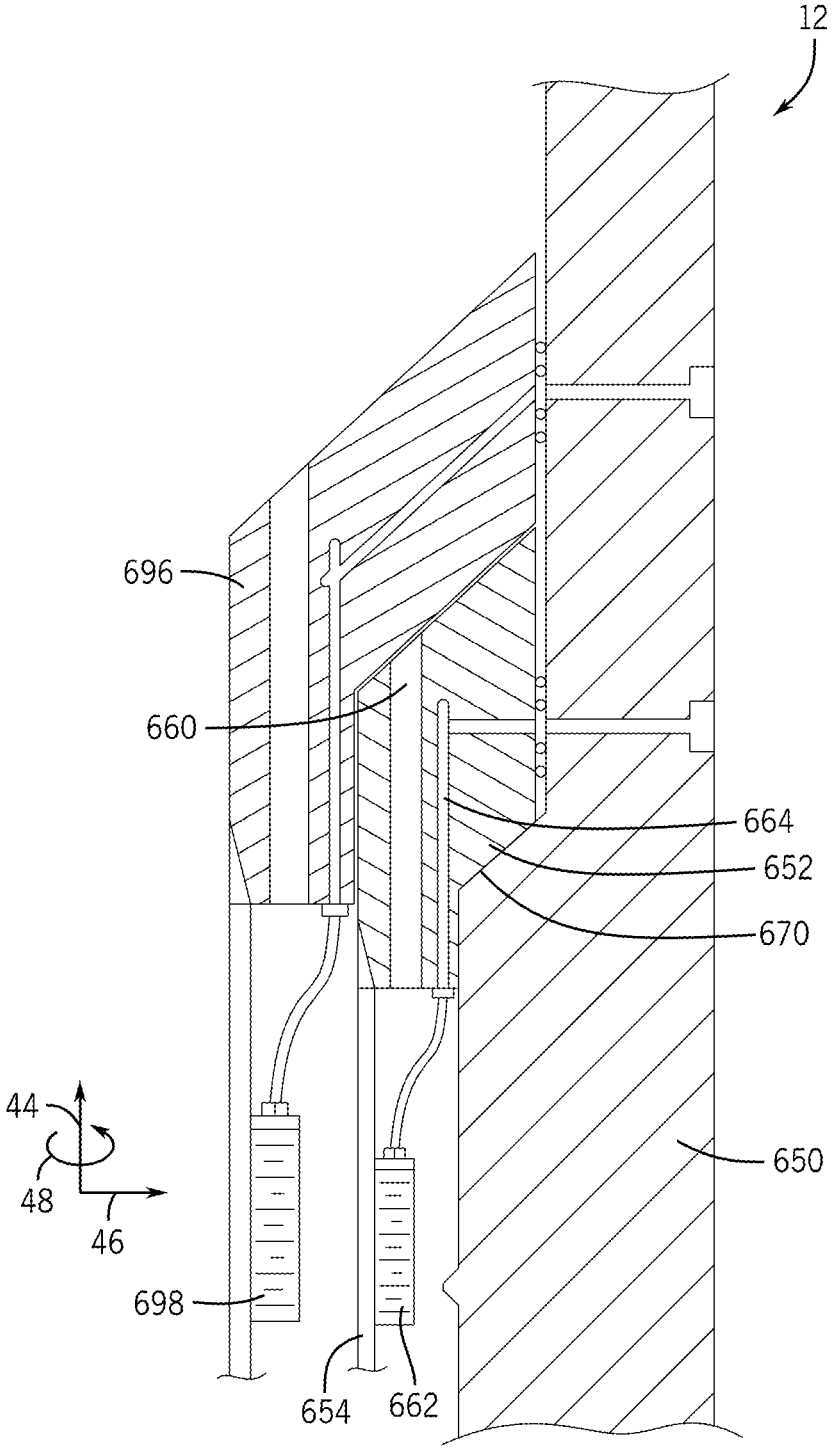
FIG. 34 is a cross-sectional side view of an embodiment of the portion of the wellhead of FIG. 31, wherein an additional hanger is supported on the hanger.

With reference of FIGS. 32 and 33, after the cementing operations, fluid may be provided via the conduit 664 to transition the seal assembly 662 to an expanded configuration (e.g., inflated). In the expanded configuration, the seal assembly 662 blocks the flow of fluid into and through the one or more passages 660 and seals the annular space between the wellhead housing 650 and the hanger 652. As shown, a push ring 692 (e.g., annular push ring) and/or a lock ring 694 (e.g., c-ring) may be provided and actuated to lock the hanger 652 in the wellhead housing 650 (e.g., the locked position). As shown in FIG. 34, multiple hangers (e.g., the hanger 652 and an additional hanger 696) and multiple seal assemblies (e.g., the seal assembly 662 and an additional seal assembly 698) may be placed in the wellhead housing 650.

Figure 36:
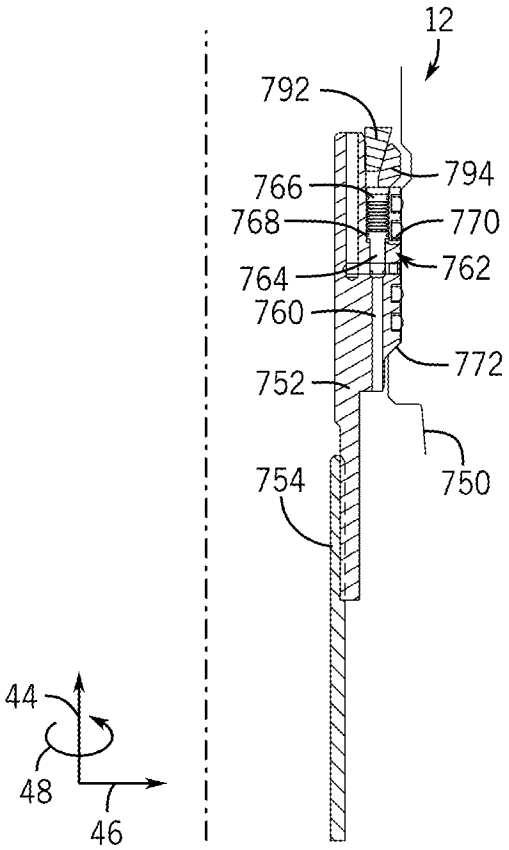
FIG. 36 is a cross-sectional side view of an embodiment of the portion of the wellhead of FIG. 35, wherein a seal assembly includes a valve assembly within the hanger.
Figure 35:
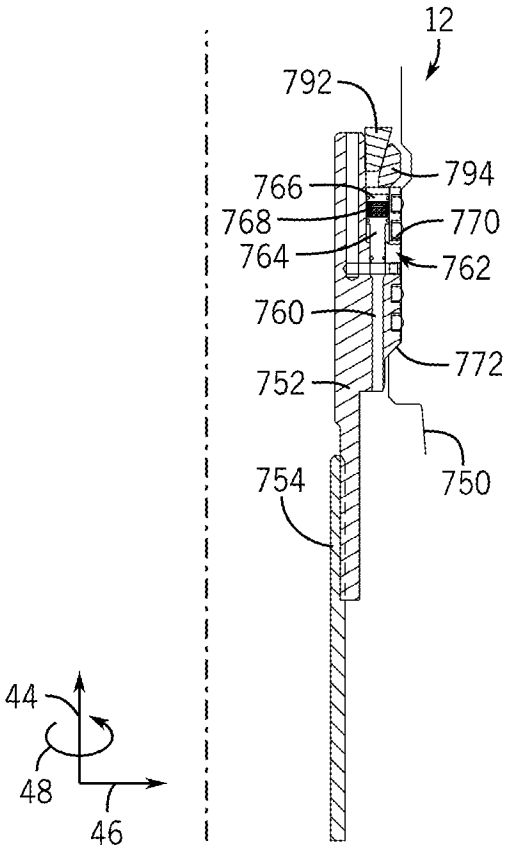
FIG. 35 is a cross-sectional side view of an embodiment of a wellhead that may be utilized in the mineral extraction system of FIG. 1, wherein a hanger includes one or more passages and is in a landed position.
Figure 37:
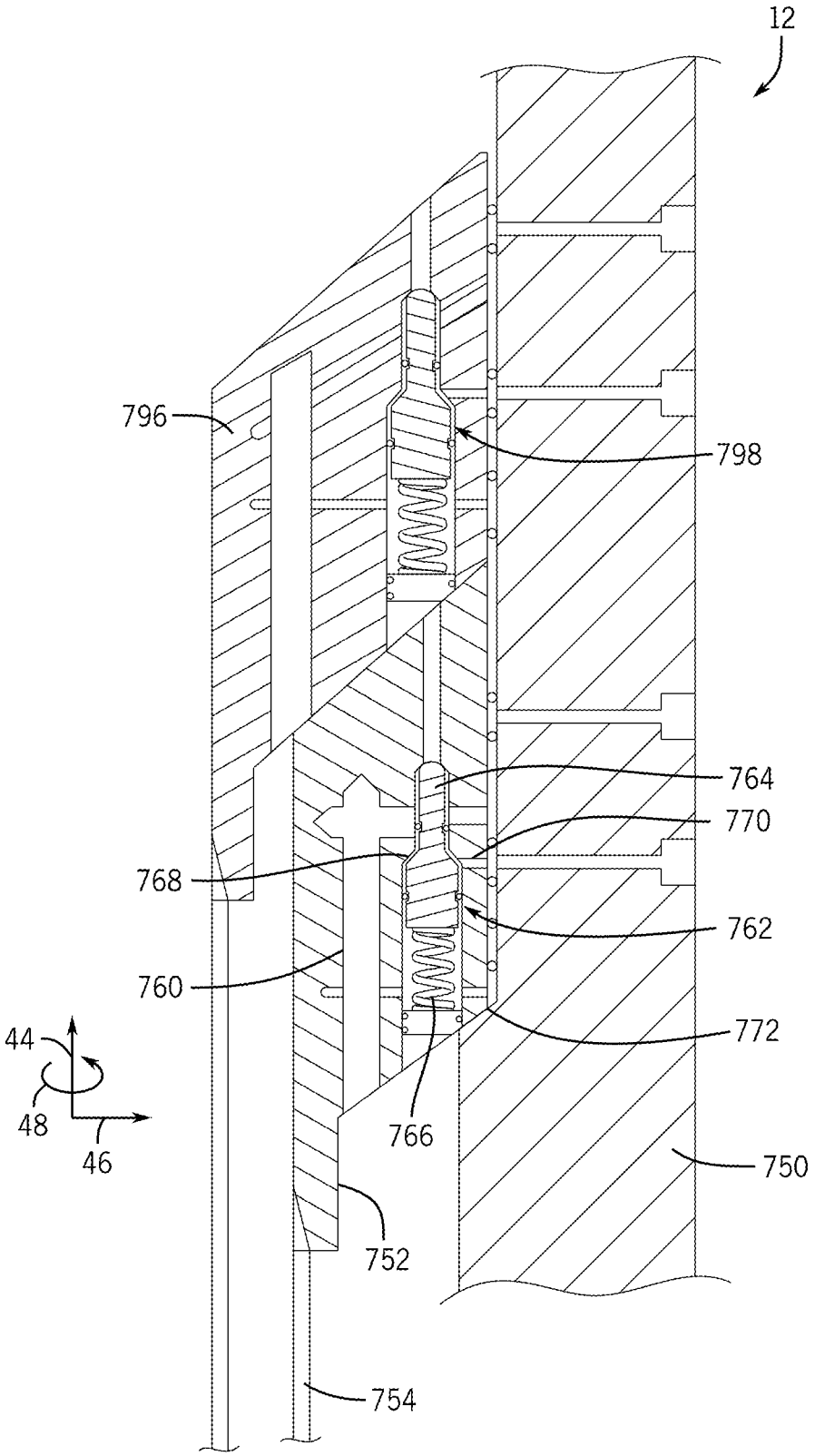
FIG. 37 is a cross-sectional side view of an embodiment of the portion of the wellhead of FIG. 35, wherein an additional hanger is supported on the hanger.

FIGS. 35-37 are cross-sectional side views of an embodiment of a portion of the wellhead 12. As shown, the portion of the wellhead 12 includes a wellhead housing 750 (e.g., a portion of a casing spool, such as a portion of the casing spool 26 of FIG. 1) and a hanger 752 (e.g., a casing hanger, such as the casing hanger 36 of FIG. 1). The hanger 752 is positioned in the wellhead housing 750 and is configured to suspend a casing 754 that extends into a wellbore. The hanger 752 includes one or more passages 760 (e.g., axial passages).

One or more seal assemblies 762 is positioned within a portion of the hanger 752. As shown, each of the one or more seal assemblies 762 may include a valve assembly with a pin 764 (e.g., valve member) and a biasing member 766 (e.g., spring) supported in a cavity 768 that is fluidly coupled to a fluid source via a conduit 770 formed through the hanger 752. The one or more passages 760 and the conduit 770 may be offset along the circumferential axis 48. In operation, a running tool may lower the hanger 752 with the casing 754 and the one or more seal assemblies 762 into the wellhead housing 750. With reference to FIG. 35, the running tool may lower the hanger 752 until the hanger 752 reaches a landed position in which the hanger 752 is landed on the wellhead housing 750 (e.g., axially facing or radially overlapping surfaces contact one another at an interface 772 to block further movement of the hanger 752 relative to the wellhead housing 750 toward the wellbore). Further, the one or more seal assemblies 762 may be in a first configuration (e.g., compressed or retracted configuration).

In the landed position and with the one or more seal assemblies 762 in the first configuration, the one or more seal assemblies 762 enables fluid flow into and through the one or more passages 760. Thus, cementing operations may commence to cement the casing within the wellbore. In this way, the one or more passages 760 provide a bypass pathway for fluid flow between a first axial location within the wellhead housing 750 (e.g., below the hanger 752; exposed to an annular space below the hanger 752) to a second axial location within the wellhead housing 750 (e.g., above the first axial location relative to the wellbore; exposed to another annular space above the hanger 752).

With reference of FIG. 36, after the cementing operations, fluid may be provided via the conduit 770 to transition the one or more seal assemblies 762 to a second configuration (e.g., expanded or extended configuration). In the second configuration, the one or more seal assemblies 762 blocks the flow of fluid into and through the one or more passages 760 (e.g., seals the one or more passages 760) to seal the annular space between the wellhead housing 750 and the hanger 752. As shown, a push ring 792 (e.g., annular push ring) and/or a lock ring 794 (e.g., c-ring) may be provided and actuated to lock the hanger 752 in the wellhead housing 750 (e.g., the locked position). As shown in FIG. 37, multiple hangers (e.g., the hanger 752 and an additional hanger 796) and multiple seal assemblies (e.g., the one or more seal assemblies 762 and an additional one or more seal assemblies 798) may be placed in the wellhead housing 750.

As shown in FIGS. 1-27, a running tool may lower a hanger with a casing, a seal assembly, and a lock ring into a wellhead housing. Further, the seal assembly may remain in the wellhead housing during the cementing operations and may enable a flow of cement across the hanger during the cementing operations. However, at least one of the hanger with the casing or the seal assembly may move relative to the wellhead housing after the cementing operations to seal an annular space between the hanger and the wellhead housing. Further, in some embodiments, no additional seal packoff elements or steps are inserted to seal the hanger to the wellhead housing after the cementing operations.

Figure 38:
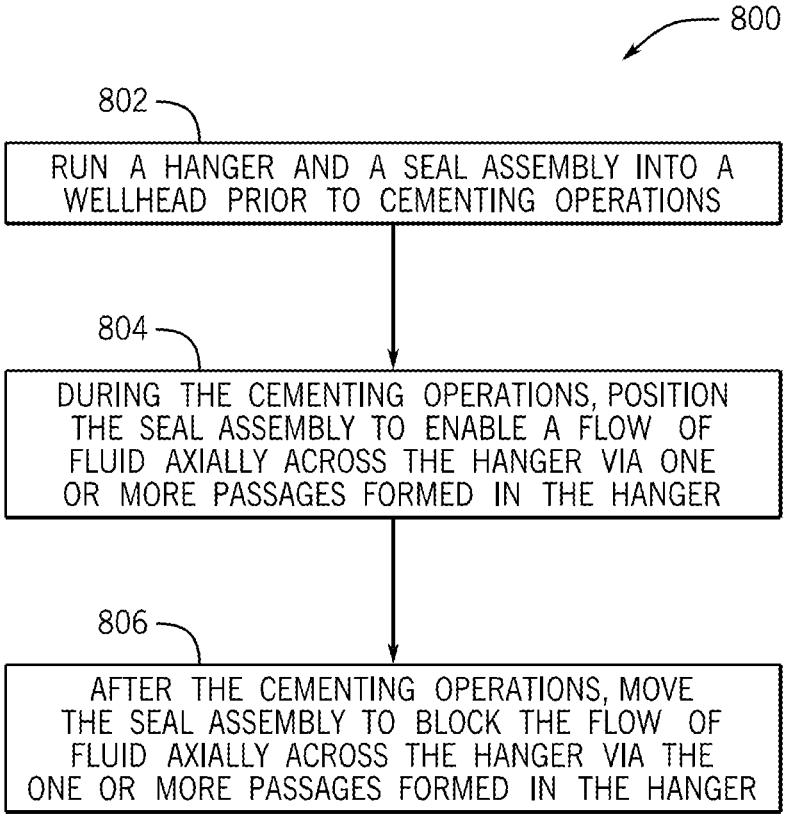
FIG. 38 is a flow diagram of an embodiment of a method of operating a wellhead to efficiently route fluid through one or more passages through a hanger and to seal the hanger in a wellhead housing.

FIG. 38 is a flow diagram of an embodiment of a method 800 of operating a wellhead (e.g., the wellhead 12 of FIGS. 1-37) to efficiently route fluid through one or more passages in a hanger and to seal the hanger in the wellhead housing. The method 800 disclosed herein includes various steps represented by blocks. It should be noted that at least some steps of the method 800 may be performed as an automated procedure by a system, such as an electronic control system for the wellhead. Although the flow chart illustrates the steps in a certain sequence, it should be understood that the steps may be performed in any suitable order and certain steps may be carried out simultaneously, where appropriate.

In block 802, the method 800 may begin with running a hanger and a seal assembly into a wellhead housing. Other components, such as one or more lock rings, may also be run with the hanger and the seal assembly into the wellhead housing. The hanger and/or the seal assembly may include one or more seal elements (e.g., elastomer or metal seals; o-rings; annular seals), including one or more seal elements that are configured to seal an annular space between the hanger and the wellhead housing.

In block 804, cementing operations may commence once the hanger and the seal assembly are positioned in the wellhead housing. During the cementing operations, the seal assembly may be positioned to enable a flow of fluid axially across the hanger via one or more passages formed in the hanger. For example, the one or more passages may include first opening(s) that are exposed to cement returns between the hanger and the wellhead housing below the hanger, as well as second opening(s) that are exposed to a channel or other path within the wellhead housing above the hanger. The one or more passages may be open (e.g., not sealed, blocked, and/or obstructed by the seal assembly) to enable the flow of fluid axially across the hanger via the one or more passages.

In block 806, after the cementing operations, the seal assembly may be positioned to block the flow of fluid axially across the hanger via the one or more passages formed in or through the hanger. For example, the seal assembly may be moved axially relative to the one or more passages and/or may be driven to rotate relative to the one or more passages to block and/or cover the one or more passages.

While the disclosure may be susceptible to various modifications and alternative forms, specific embodiments have been shown by way of example in the drawings and have been described in detail herein. However, it should be understood that the disclosure is not intended to be limited to the particular forms disclosed. Rather, the disclosure is to cover all modifications, equivalents, and alternatives falling within the spirit and scope of the invention as defined by the following appended claims. For example, while the illustrated embodiments show a hanger and a housing of a wellhead, it should be understood that the systems and methods may be adapted to for use with any of a variety of other annular structures. Additionally, any features shown or described with reference to FIGS. 1-38 may be combined in any suitable manner. For example, a retaining wire (e.g., similar to the retaining wire 272 of FIG. 14) or any suitable component may be incorporated into any embodiment disclosed herein to facilitate retrieval of a seal body. As another example, a test port (e.g., similar to the test port 1160 of FIG. 7) may be incorporated into any embodiment disclosed herein to facilitate testing of seals.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A wellhead system, comprising:

a wellhead housing;

a hanger configured to support a casing within the wellhead housing, wherein the hanger comprises one or more passages, each passage including a hole formed through a body of the hanger;

a seal assembly configured to move relative to the hanger to selectively enable a flow of fluid across the hanger via the one or more passages, wherein at least a portion of the seal assembly is coupled to the hanger via a threaded interface; and a running tool, wherein the running tool is coupled to the hanger via an additional threaded interface, the threaded interface comprises a first direction thread, and the additional threaded interface comprises a second direction thread, wherein rotation of the running tool in a first direction causes the running tool to unthread from the hanger and causes the portion of the seal assembly to thread onto the hanger.

2. The wellhead system of claim 1, wherein the seal assembly is configured to move axially relative to the hanger to selectively enable the flow of fluid across the hanger via the one or more passages.

3. The wellhead system of claim 1, wherein the portion of the seal assembly is configured to rotate relative to the hanger to selectively enable the flow of fluid across the hanger via the one or more passages.

4. The wellhead system of claim 1, wherein the seal assembly comprises a ring, a plunger, a valve, an inflatable bladder, or any combination thereof.

5. The wellhead system of claim 1, wherein the seal assembly comprises an annular seal body with one or more annular seal elements, the hanger comprises an annular pocket, and the annular seal body is configured to insert into the annular pocket to block the flow of fluid across the hanger via the one or more passages.

6. The wellhead system of claim 1, wherein the one or more passages comprise multiple passages distributed circumferentially about the hanger.

7. The wellhead of claim 1, comprising a torque sleeve configured to transfer rotational force from the running tool to the portion of the seal assembly.

8. A wellhead system, comprising:

a wellhead housing;

a hanger configured to support a casing within the wellhead housing, wherein the hanger comprises one or more passages formed through the hanger;

a seal assembly configured to move relative to the hanger to selectively enable a flow of fluid across the hanger via the one or more passages, wherein at least a portion of the seal assembly is coupled to the hanger via a first threaded interface including a first thread on a first surface of the hanger and having a first thread direction; and a running tool, wherein the running tool is coupled to the hanger via a second threaded interface axially displaced with respect to the first threaded interface, and including a second thread on a second surface of the hanger and having a second thread direction different from the first thread direction.

9. The wellhead system of claim 8, wherein the seal assembly is configured to move axially relative to the hanger to selectively enable the flow of fluid across the hanger via the one or more passages.

10. The wellhead system of claim 8, wherein the portion of the seal assembly is configured to rotate relative to the hanger to selectively enable the flow of fluid across the hanger via the one or more passages.

11. The wellhead system of claim 8, wherein the seal assembly comprises a ring, a plunger, a valve, an inflatable bladder, or any combination thereof.

12. The wellhead system of claim 8, wherein the seal assembly comprises an annular seal body with one or more annular seal elements, the hanger comprises an annular pocket, and the annular seal body is configured to insert into the annular pocket to block the flow of fluid across the hanger via the one or more passages.

13. The wellhead system of claim 8, wherein the one or more passages comprise multiple passages distributed circumferentially about the hanger.

14. The wellhead of claim 8, wherein rotation of the running tool in a first direction causes the running tool to unthread from the hanger and causes the portion of the seal assembly to thread onto the hanger.

15. The wellhead of claim 14, comprising a torque sleeve configured to transfer rotational force from the running tool to the portion of the seal assembly.

16. A wellhead system, comprising:

a wellhead housing;

a hanger configured to support a casing within the wellhead housing, wherein the hanger comprises one or more passages, each passage including a hole formed through a body of the hanger;

a seal assembly configured to move relative to the hanger to selectively enable a flow of fluid across the hanger via the one or more passages, wherein at least a portion of the seal assembly is coupled to the hanger via a threaded interface; and a running tool, wherein the running tool is coupled to the hanger via an additional threaded interface, the threaded interface comprises a first direction thread, and the additional threaded interface comprises a second direction thread, wherein the portion of the seal assembly is configured to rotate relative to the hanger to selectively enable the flow of fluid across the hanger via the one or more passages.

* * * * *